US011332225B2

(12) United States Patent
Jacobson

(10) Patent No.: US 11,332,225 B2
(45) Date of Patent: May 17, 2022

(54) COLD WEATHER SURVIVAL SUIT

(71) Applicant: Diego Jacobson, Humacao, PR (US)

(72) Inventor: Diego Jacobson, Humacao, PR (US)

( * ) Notice: Subject to any disclaimer, the term of this patent is extended or adjusted under 35 U.S.C. 154(b) by 0 days.

(21) Appl. No.: 17/109,802

(22) Filed: Dec. 2, 2020

(65) Prior Publication Data

US 2021/0171167 A1 Jun. 10, 2021

Related U.S. Application Data

(60) Provisional application No. 62/948,443, filed on Dec. 16, 2019, provisional application No. 62/945,424, filed on Dec. 9, 2019.

(51) Int. Cl.
*B63C 9/105* (2006.01)
*A41D 13/012* (2006.01)

(52) U.S. Cl.
CPC ..... *B63C 9/105* (2013.01); *A41D 13/0125* (2013.01)

(58) Field of Classification Search
CPC ..... B63C 9/093; B63C 9/105; B63C 9/1055; B63C 2011/043; B63C 20/04; A41D 13/05
See application file for complete search history.

(56) References Cited

U.S. PATENT DOCUMENTS

| | | | | |
|---|---|---|---|---|
| 4,704,092 | A | 11/1987 | Liukko | |
| 6,206,744 | B1 | 3/2001 | Wigutow | |
| 6,430,942 | B1 | 8/2002 | Pillai et al. | |
| 6,706,744 | B2 | 3/2004 | Madsen et al. | |
| 8,632,374 | B2 * | 1/2014 | Nunez | B63C 9/125 441/102 |
| 2010/0100994 | A1 * | 4/2010 | Ehime | B32B 25/10 2/2.16 |
| 2011/0177732 | A1 | 7/2011 | Clifford | |
| 2019/0308700 | A1 * | 10/2019 | Vignola | B63C 9/087 |

* cited by examiner

*Primary Examiner* — Andrew Polay
(74) *Attorney, Agent, or Firm* — Luis Figarella; Robert Isackson

(57) ABSTRACT

A cold weather survival suit includes a principal body cavity having pneumatically connected extensions to fit body extremities and a coverable cranial opening. The structure of the suit includes a layered structure of mechanically interconnected suits within suits. A composite of tear-proof and insulation material forms an internal suit or first envelope that is surrounded by a waterproof suit and then by a tear resistant suit.

17 Claims, 19 Drawing Sheets

COLD WEATHER SURVIVAL SUIT

CROSS-REFERENCE TO RELATED APPLICATIONS

This application claims priority to co-pending U.S. Provisional patent application Ser. No. 62/945,424 titled "Survival Suit Fabric and Suit", filed on Dec. 9, 2019, and Ser. No. 62/948,443 titled "Survival Suit Fabric and Suit", filed on Dec. 16, 2019, the disclosure of both are herein incorporated by reference in their entirety.

PATENTS CITED

The following documents and references are incorporated by reference in their entirety, Wigutow (U.S. pat. No. 6,206,744), Liukko (U.S. Pat. No. 4,704,092), Clifford (U.S. Pat. Pub. No. 2011/0177732), Vignola (U.S. Pat. Pub. No. 2019/0308700) and Nunez (U.S. Pat. No. 8,632,374).

FIELD OF THE INVENTION

The invention relates to cold weather or artic conditions survival comfort clothing, and specifically to cold weather conditions survival suits.

DESCRIPTION OF THE RELATED ART

Survival suits and other assistance garments/devices are intended to be used and/or available to operators and passengers of boats/platforms during cold and artic weather. Many of these suits contain insulation/impermeable layers to keep the wearer warm and (if possible) dry, and they may contain a flotation element that provides buoyancy to keep the wearer afloat when in the water. Some also are flame resistant as ship/platform abandonments happen during fires.

Hypothermia can claim a victim's life in less than 15 minutes, leaving no room for error when it comes to the protective qualities of a cold-water immersion suits. While there are many professional garments, these take a long time to put on, usually involve practicing and even the assistance of someone else. A casual user or ship passenger unit, designed for the emergency use of the general population, requires quick donning by an effectively un-trained group of users.

Today's immersion suits are required (per 46 CFR 160.171-17) to maintain body heat for up to 6 hours, to be certified by Underwriters Laboratories, Inc. and as of 2017 to be SOLAS and the International Maritime Organization's (IMO) Maritime Safety Committee (MSC) Life-Saving Appliance (LSA) Code (RESOLUTION MSC.48(66) as amended through Res. MSC.207(81)); evaluated and tested in accordance with Res. MSC.81(70), as amended through Res. MSC.226(82). Identifying Data: 46 CFR 160.171 and UL Report File No. MQ 7228. Additional requirements include ISO 15027-2 for "Immersion Suits—Part 2: Abandonment Suits, Requirements including safety".

All of the above, is further tempered by the acceptance that rescue within that timeframe is never guaranteed. What is needed are improvements in materials combinations and ergonomic design to provide an easier to put on, better heat preserving cold weather suit, that delivers on improved survival times (beyond the required 6 hrs., perhaps 12+ hrs.) in both water and on life-raft and icefloes/ice covered surfaces.

SUMMARY OF THE INVENTION

This section is for the purpose of summarizing some aspects of the present invention and to briefly introduce some embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e., that it will be taken to mean an inclusion of not only the listed components it directly references, but also other non-specified components or elements. This rationale will also be used when the term 'comprised' or 'comprising' is used in relation to one or more steps in a method or process.

In one aspect, the invention is about a flexible cold weather survival suit for a user comprising: a first inner thermal layer forming a central cavity pneumatically connected to two leg extensions, two arm extensions and a head covering having a face opening, wherein said thermal layer cavity includes one or more attachment components at various locations of said thermal layer's exterior, wherein said thermal layer comprises an internal lining layer and a thermally insulating bubble layer attached together, wherein said thermal layer bubbles are comprised of similar sized bubbles that have a diameter of between 5 mm and 15 mm and a height of 3 mm to 6 mm, a second waterproof layer dimensioned to envelop said inner thermal layer, said waterproof layer including one or more internal attachment components complementary to said thermal layer's attachment components, so as to couple said waterproof layer together to said inner thermal layer, wherein said waterproof layer is formed from a waterproof material, including a flexible hood having a seal around the user's face area of said thermal layer's head covering and said second layer has one or more front opening/closing mechanical components for sealing the interior of said second layer, including said thermal cavity. In another aspect, said internal lining materials are comprised of one or more of: ripstop fabric, ripstop nylon, Dyneema®, silnylon or cordura, said thermally insulating materials are comprised of one or more of: bubble layer, bubble layer with foil, radiant foil or aerogel and said waterproof layer materials are comprised of one or more of: plastic film, polyether film or polyurethane. In yet another aspect, an internal suit storage pocket is affixed to one of said waterproof layer interior and said inner thermal layer.

In another aspect, each said leg extension includes a sandal-like foot support structure outside said waterproof layer in addition to a strap completely surrounding said waterproof layer, so that cinching said strap pneumatically separates the distal foot area from said central cavity leg extension and each said leg extension include an external foot sole. In yet another aspect, said external foot sole includes a stave. In another aspect, said bubble layers include aluminized layers on their exteriors. In another aspect, one or more attachment components added to the exterior of said waterproof layer, a third protective outer layer enveloping said waterproof layer, said outer layer including internal attachment components complementary to said waterproof's layer external attachment components, so as to couple said outer layer to said waterproof layer and wherein said outer layer is formed from one or more materials, including wear resistant fibers, mechanical closure components, and slip resistant soles. In yet another aspect, said internal lining materials are comprised of one or more of: ripstop fabric, ripstop nylon, Dyneema®, silnylon or cordura, said thermally insulating materials are comprised of one or more of: bubble layer, bubble layer with foil, radiant foil or aerogel, and said waterproof layer materials are comprised of one or more of: plastic film, polyether film, neoprene or polyurethane and said outer layer materials are comprised of one or more of: Nylon, Denier Oxford Nylon, plastic or water-repellent fibers. In another aspect each said leg extension includes a sandal-like foot support structure outside said waterproof layer, each said leg extension includes an external strap linked to an internal strap surrounding said waterproof film layer, so that cinching of said external strap pneumatically separates the foot area from said central cavity leg extension; and each said leg extension includes an external foot sole. In yet another aspect said waterproof layer includes an internal suit storage pocket is affixed to one of said waterproof layer interior and said inner thermal layer.

In one aspect, the invention is about a flexible cold weather survival suit for a user comprising: a first inner thermal layer forming a central cavity pneumatically connected to two leg extensions, two arm extensions and a head covering having a face opening, wherein said thermal layer cavity includes one or more attachment components at various locations of said thermal layer's exterior, wherein said thermal layer comprises an internal lining layer and a thermally insulating bubble layer attached together, a second waterproof layer dimensioned to envelop said inner thermal layer, said waterproof layer including one or more internal attachment components complementary to said thermal layer's attachment components, so as to couple said waterproof layer together to said inner thermal layer, wherein said waterproof layer is formed from a waterproof material, including a flexible hood having a seal around the user's face area of said thermal layer's head covering and said second layer has one or more front opening/closing mechanical components for sealing the interior of said second layer, including said thermal cavity, and each said leg extension includes a sandal-like foot support structure outside said waterproof layer in addition to a strap completely surrounding said waterproof layer, so that cinching said strap pneumatically separates the distal foot area from said central cavity leg extension. In another aspect, said internal lining materials are comprised of one or more of: ripstop fabric, ripstop nylon, Dyneema®, silnylon or cordura, said thermally insulating materials are comprised of one or more of: bubble layer, bubble layer with foil, radiant foil or aerogel and said waterproof layer materials are comprised of one or more of: plastic film, polyether film or polyurethane. In yet another aspect, an internal suit storage pocket is affixed to one of said waterproof layer interior and said inner thermal layer.

In another aspect, each said leg extension includes a sandal-like foot support structure outside said waterproof layer in addition to a strap completely surrounding said waterproof layer, so that cinching said strap pneumatically separates the distal foot area from said central cavity leg extension and each said leg extension include an external foot sole. In yet another aspect, said external foot sole includes a stave. In another aspect, said thermal layer bubbles are comprised of similar sized bubbles that have a diameter of between 5 mm and 15 mm and a height of 3 mm to 6 mm and said bubble layers include aluminized layers on their exteriors. In another aspect, one or more attachment components added to the exterior of said waterproof layer, a third protective outer layer enveloping said waterproof layer, said outer layer including internal attachment components complementary to said waterproof's layer external attachment components, so as to couple said outer layer to said waterproof layer and wherein said outer layer is formed from one or more materials, including wear resistant fibers, mechanical closure components, and slip resistant soles. In yet another aspect, said internal lining materials are comprised of one or more of: ripstop fabric, ripstop nylon, Dyneema®, silnylon or cordura, said thermally insulating materials are comprised of one or more of: bubble layer, bubble layer with foil, radiant foil or aerogel, and said waterproof layer materials are comprised of one or more of: plastic film, polyether film, neoprene or polyurethane and said outer layer materials are comprised of one or more of: Nylon, Denier Oxford Nylon, plastic or water-repellent fibers. In another aspect each said leg extension includes a sandal-like foot support structure outside said waterproof layer, each said leg extension includes an external strap linked to an internal strap surrounding said waterproof film layer, so that cinching of said external strap pneumatically separates the foot area from said central cavity leg extension; and each said leg extension includes an external foot sole. In yet another aspect said waterproof layer includes an internal suit storage pocket is affixed to one of said waterproof layer interior and said inner thermal layer.

In one aspect, the invention is about a survival suit kit comprising a bag or container with a carry strap, said bag/container containing: a flexible cold weather survival suit for a user comprising: a first inner thermal layer forming a central cavity pneumatically connected to two leg extensions, two arm extensions and a head covering having a face opening, wherein said thermal layer cavity includes one or more attachment components at various locations of said thermal layer's exterior, wherein said thermal layer comprises an internal lining layer and a thermally insulating bubble layer attached together, said thermal layer bubbles are comprised of bubbles that are between 5 mm and 15 mm, a second waterproof layer dimensioned to envelop said inner thermal layer, said waterproof layer including one or more internal attachment components complementary to said thermal layer's attachment components, so as to couple said waterproof layer together to said inner thermal layer, wherein said waterproof layer is formed from a waterproof material, including a flexible hood having a seal around the user's face area of said thermal layer's head covering and said second layer has one or more front opening/closing mechanical components for sealing the interior of said second layer, including said thermal cavity. In another aspect, said internal lining materials are comprised of one or more of: ripstop fabric, ripstop nylon, Dyneema®, silnylon or cordura, said thermally insulating materials are comprised of one or more of: bubble layer, bubble layer with foil, radiant foil or aerogel and said waterproof layer materials are comprised of one or more of: plastic film, polyether film or polyurethane. In yet another aspect, an internal suit storage pocket is affixed to one of said waterproof layer interior and said inner thermal layer.

In another aspect, each said leg extension includes a sandal-like foot support structure outside said waterproof layer in addition to a strap completely surrounding said waterproof layer, so that cinching said strap pneumatically separates the distal foot area from said central cavity leg extension and each said leg extension include an external foot sole. In yet another aspect, said external foot sole includes a stave. In another aspect, said bubble layers include aluminized layers on their exteriors. In another aspect, one or more attachment components added to the exterior of said waterproof layer, a third protective outer layer enveloping said waterproof layer, said outer layer including internal attachment components complementary to said waterproof's layer external attachment components, so as to couple said outer layer to said waterproof layer and wherein said outer layer is formed from one or more materials, including wear resistant fibers, mechanical closure components, and slip resistant soles. In yet another aspect, said internal lining materials are comprised of one or more of: ripstop fabric, ripstop nylon, Dyneema®, silnylon or cordura, said thermally insulating materials are comprised of one or more of: bubble layer, bubble layer with foil, radiant foil or aerogel, said waterproof layer materials are comprised of one or more of: plastic film, polyether film, neoprene or polyurethane and said outer layer materials are comprised of one or more of: Nylon, Denier Oxford Nylon, plastic or water-repellent fibers. In another aspect each said leg extension includes a sandal-like foot support structure outside said waterproof layer, each said leg extension includes an external strap linked to an internal strap surrounding said waterproof film layer, so that cinching of said external strap pneumatically separates the foot area from said central cavity leg extension; and each said leg extension includes an external foot sole. In yet another aspect said waterproof layer includes an internal suit storage pocket is affixed to one of said waterproof layer interior and said inner thermal layer.

Other features and advantages of the present invention will become apparent upon examining the following detailed description of an embodiment thereof, taken in conjunction with the attached drawings, which are provided for purposes of illustration and not of limitation.

Figure 1:
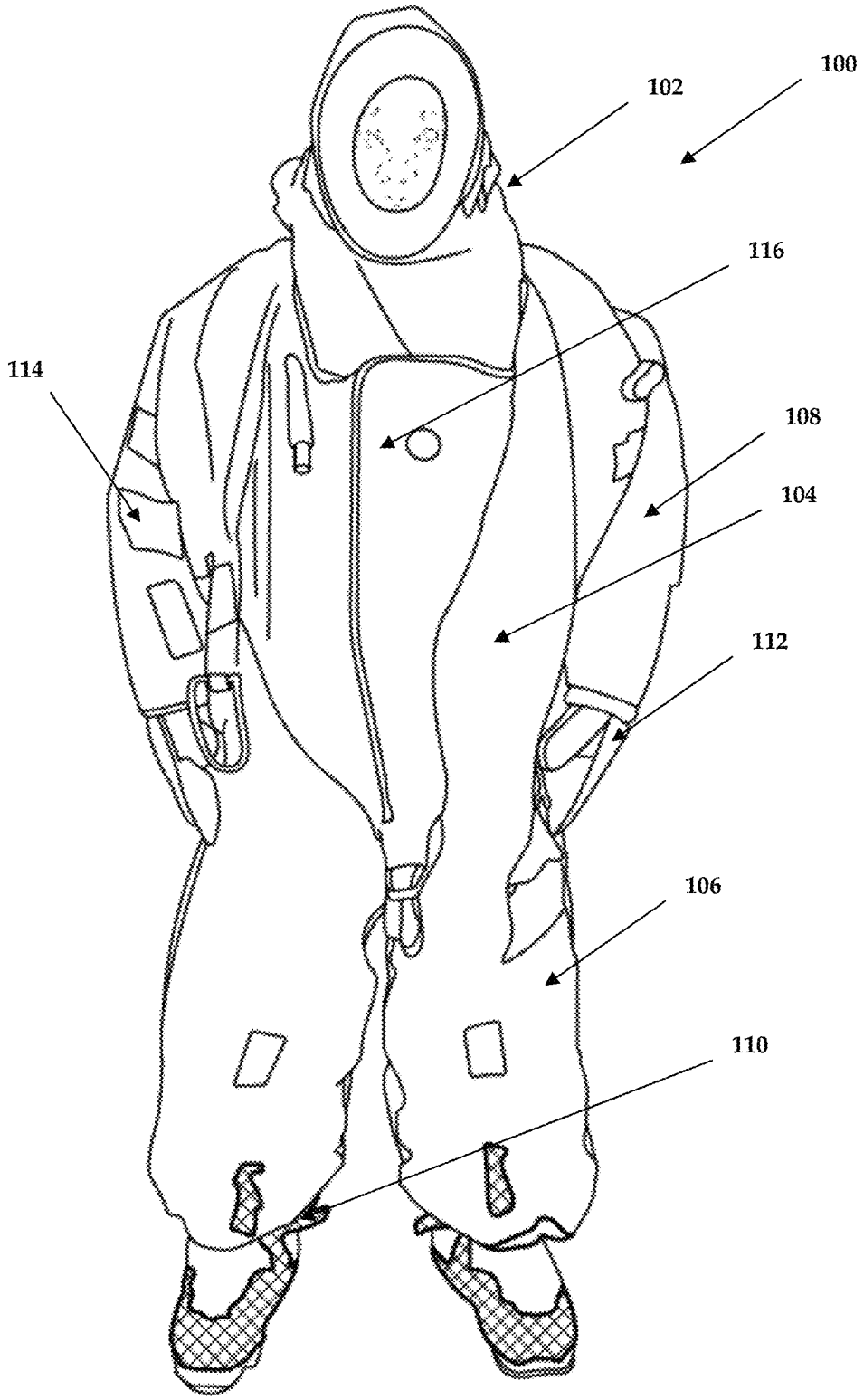
FIG. 1 shows a front perspective of the cold weather survival suit, according to an exemplary embodiment of the invention.
Figure 2:
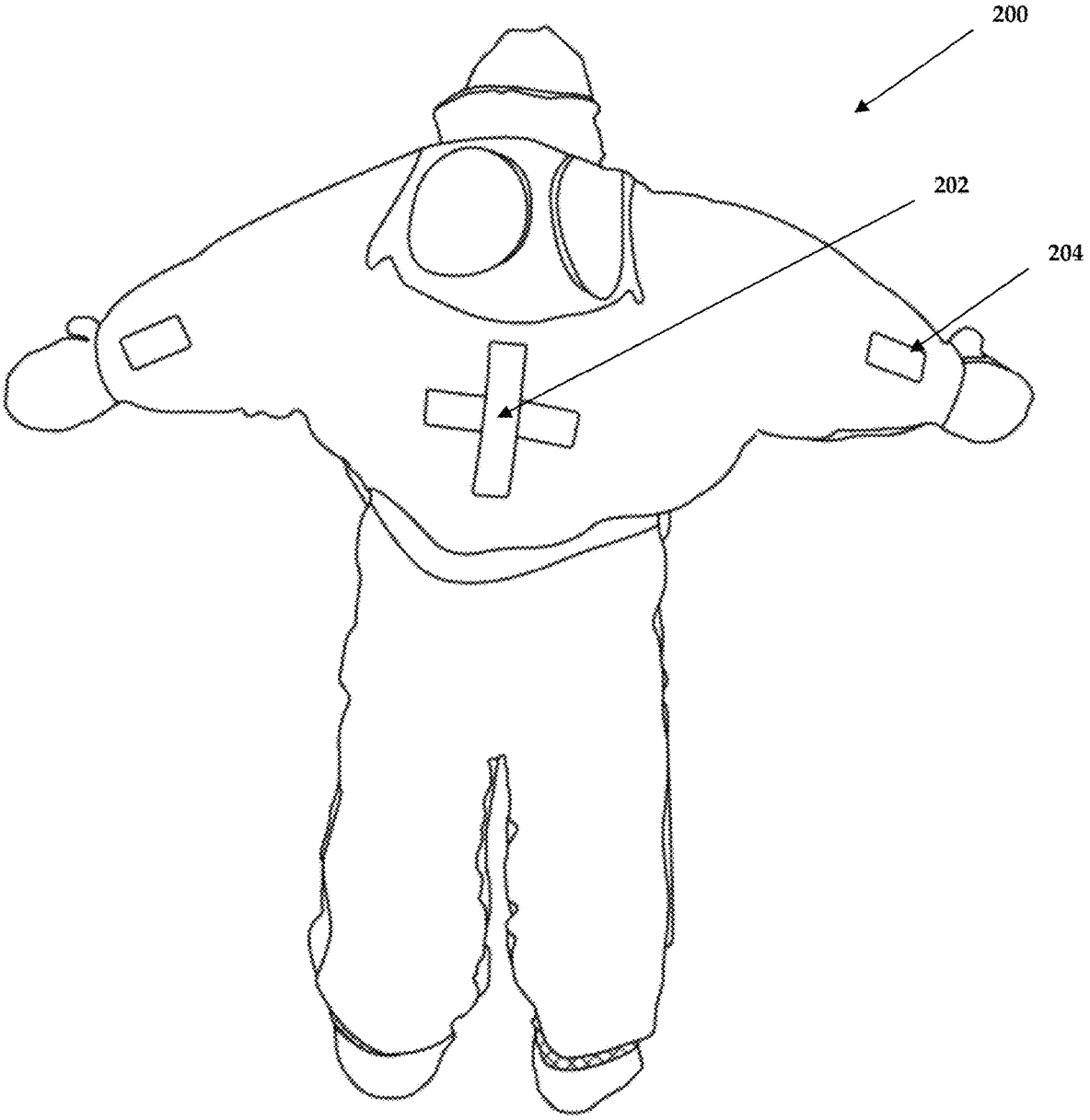
FIG. 2 shows a back-perspective view of the cold weather survival suit, according to an exemplary embodiment of the invention.
Figure 3:
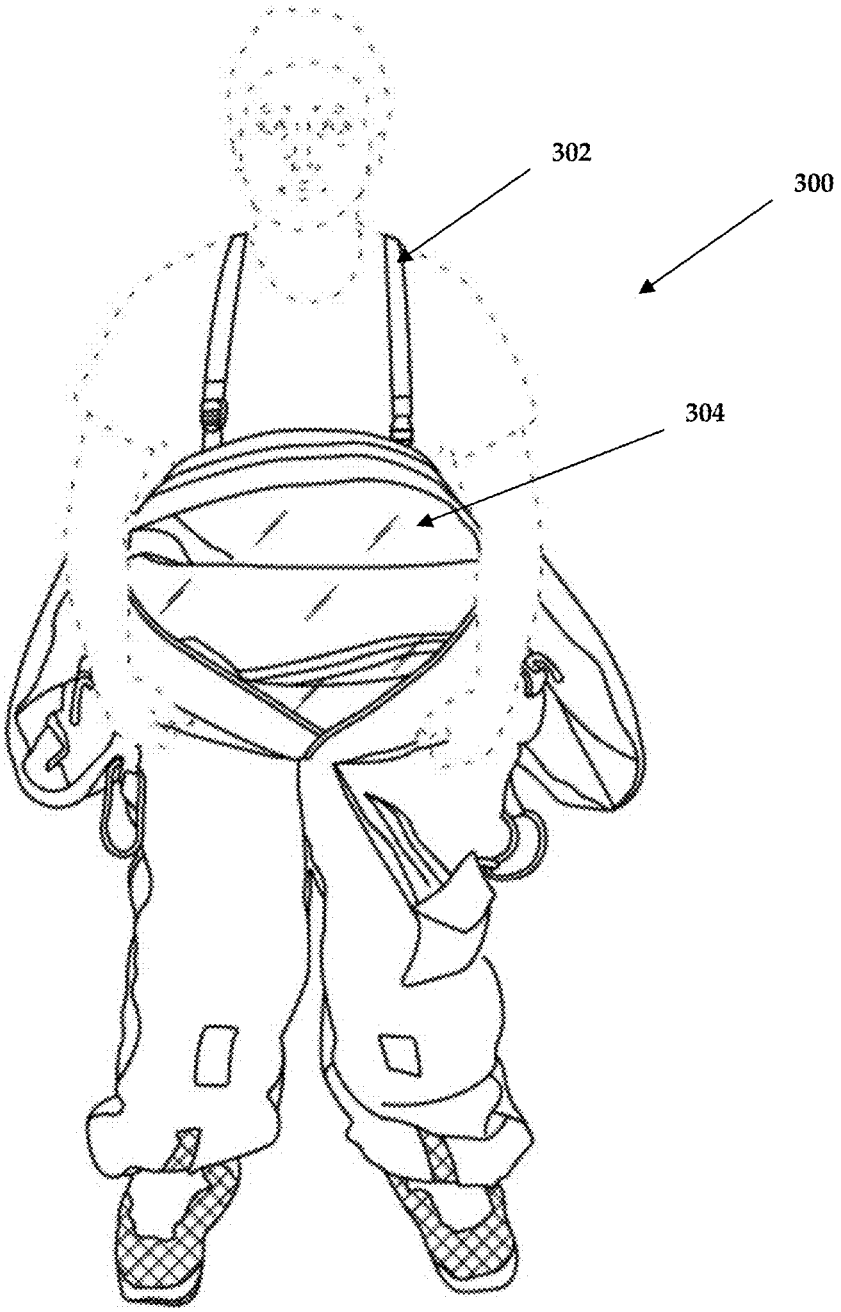
FIG. 3 shows a front perspective view of a partially donned cold weather survival suit, according to an exemplary embodiment of the invention.
Figure 4:
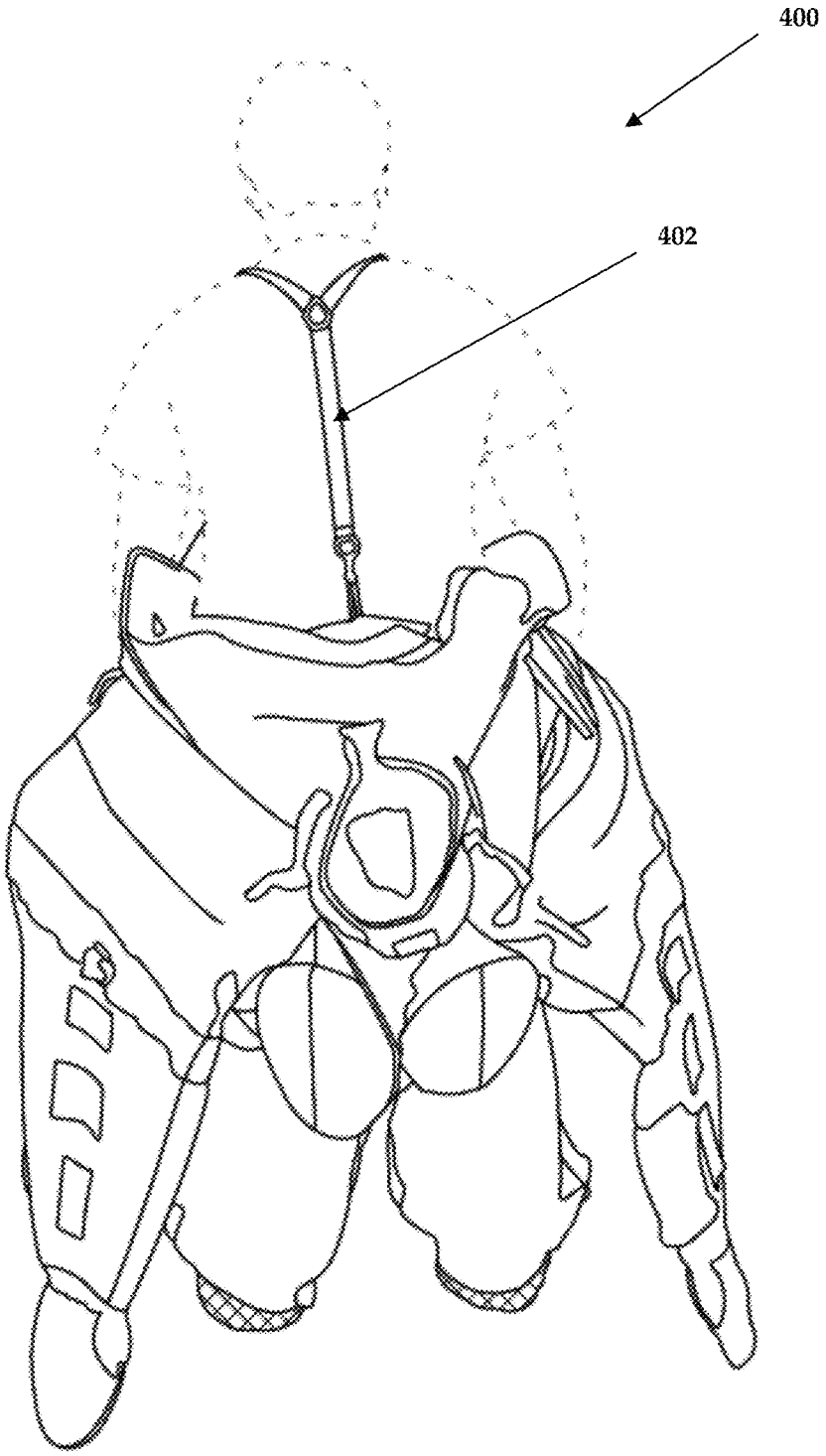
FIG. 4 shows a back-perspective view of a partially donned cold weather survival suit, according to an exemplary embodiment of the invention.
Figure 5:
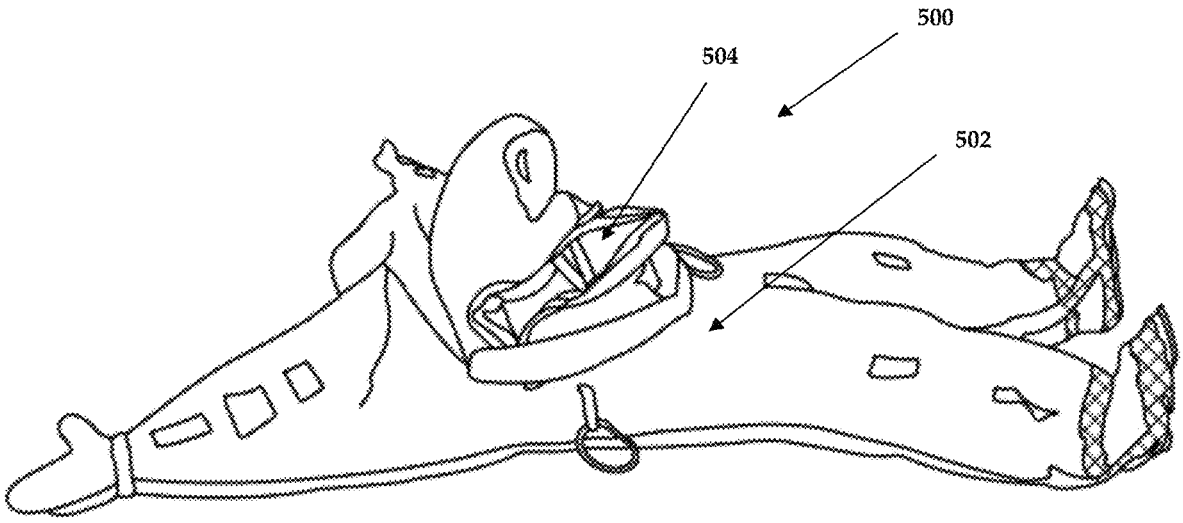
FIG. 5 shows a cold weather survival suit laying on its back, according to an exemplary embodiment of the invention.

The above-described and other features will be appreciated and understood by those skilled in the art from the following detailed description and drawings.

DETAILED DESCRIPTION OF THE INVENTION

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

The present invention, referring to FIGS. 1-5, is comprised of a cold weather or Artic survival suit 100 suitable for use by un-trained or inexperienced users as well as highly experienced users. The suit is made from a fabric comprised of a multi-layered composite fabric 600 and crafted to create a climate resistant enclosure for the body that is easy to don and close with minimal or no previous training. We note that even though we focus in this application on the survival suit 100 embodiment, the fabric 600 may be used to create other similar garments (baby/infant enclosures), clothing such as pants and jackets, and accoutrements (tents, shelters, rafts, sleeping bags, blankets) or combination thereof.

The suit 100 is comprised of a singular pneumatic internal cavity divided into a torso 104, hood or head cover 102, two arms 108 and two legs 106. In one embodiment, integral mittens 112 are placed at the end of the arm 108 extensions, a hood assembly at the head opening and a foot area adjustment external strap assembly 110 at the end of the leg 106 extensions. Both the front 100 and back 200 of the suit may contain one or more high visibility features 202/204 to facilitate location of the user in open water or ice. In another embodiment, the integral mittens 112 may be replaced with removable mittens or gloves, coupled to the sleeve by a watertight/airtight seal, and more preferably if a wrist/forearm band is added so as to prevent pneumatic communication of the internal central chamber 502 with the outside when the glove is removed.

A particular advantage of one embodiment of such a garment is the ability to at times function without completely taking it off. As seen 300/400 in FIGS. 3-4, the addition of internal suspenders 302/402 in combination with a front opening/closing component 304 (said component may be a zipper, hooks and loops (e.g. Velcro™) or other suitable sealing mechanisms) so that water is kept outside the waterproof layer 900 of the suit. These suspenders 302/402 are very valuable, as they allow the wearer a way in which to reduce/eliminate overheating (by opening the front of the suit 304) while maintaining mobility and quick re-sealing of the suit (say in the event of a quick squall) while on top of a survival vessel (raft/boat) or an icefloe.

While the suit may be donned in any position, even while standing, the ability to lay it flat before sliding into it has advantages when users are on an unstable or damaged ship. As we see in FIG. 5, when laid flat 500 the user may quickly don it by entering the cavity, in a fashion similar to that of entering a sleeping bag.

Figure 6A:
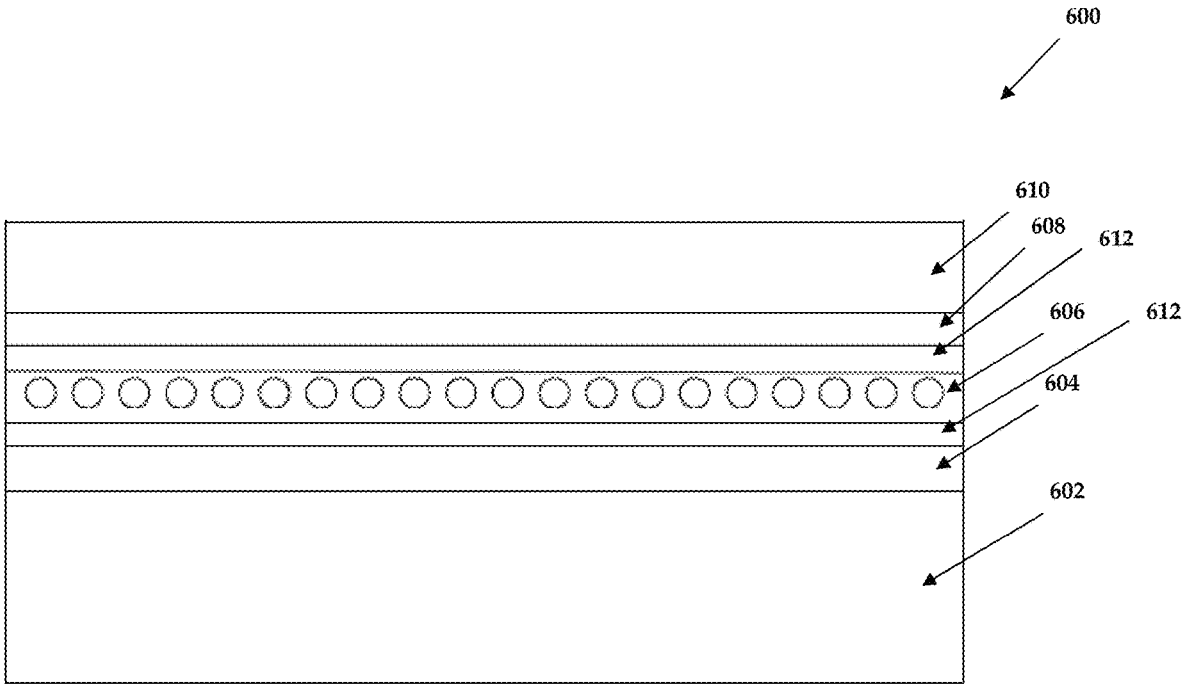
FIG. 6A shows a cross section of the material layers that comprise the various suits when nested within each other for parts of the cold weather survival suit, according to an exemplary embodiment of the invention.

In one embodiment, the suit is built from a composite fabric (FIGS. 6A-6C), with emphasis on both waterproofing and minimizing heat transfer from the inside (provided by the human within) and the exterior. In one embodiment, 600, this is accomplished by creating a multi-layer structure that begins with an inner layer 604, preferably a nylon, more preferably a ripstop nylon or equivalent, placed against the cavity/space 602 within the suit. Outside this layer, we place a Bubble material layer 606, comprised of the traditional air captured layers formed into 10 mm diameter bubbles and one or more optional reflective foil covers 612 (typically an aluminized foil or mylar), preferably the reflective foil cover being applied to one or both surfaces of the one or more layers of bubbles.

Figure 6B:
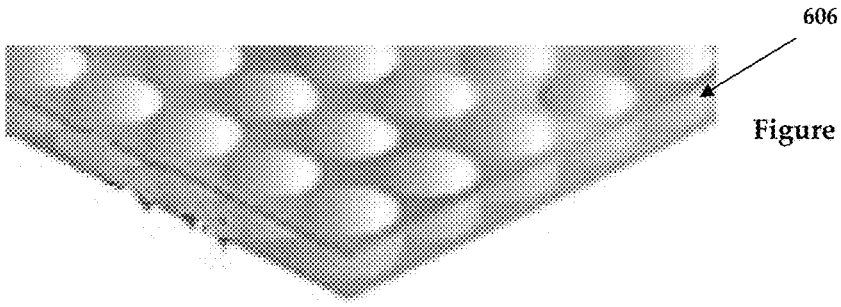
FIGS. 6B-6C show two distinct embodiments of the bubble layer of the cold weather suit, according to exemplary embodiments of the invention.
Figure 6C:
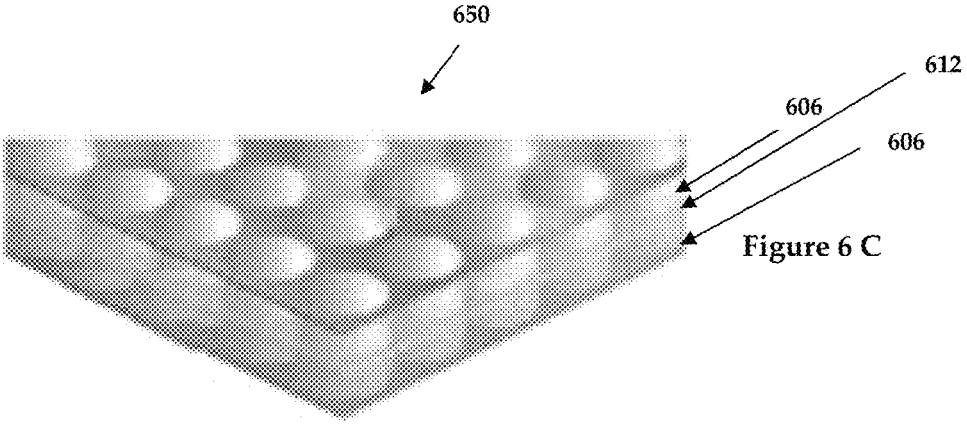

While many configurations and sizes of bubbles are envisioned, in one embodiment, we use a bubble layer 606 similar to that seen in FIGS. 6B-6C. In one embodiment, the bubbles form a cylinder of diameter from 5 mm to 15 mm, and height from 3 mm to 6 mm (see as an example TempShield™ Bubbles Foil/White, Radiant Foil, Style TS-SBFW-48). We note that even though the shown shape for the bubbles is a cylindrical one, other suitable shapes includes spheres, squares, rectangles, etc. This bubble material, traditionally used for insulation in construction sites, may be found under the TempShield™ brand as single 606 or double bubbles 650 as well as the option of a reflective metalized material between them, forming in one embodiment a 3 mm to 6 mm thick material (which may be double or triple or more layered) with bubbles that are in one embodiment 10 mm diameter, but may range from 5 mm to 15 mm diameter. The bubble layer 606 may be obtained from a supplier such as Radiant Foil.

The gas bubbles trapped within he bubbles layer 606 act as an insulating layer, that will minimize the wearer's heat from escaping the inside cavity of the suit where the user lies. The smaller size allows for significant flexibility in wearability.

The preferred ripstop nylon layer 604 is secured, preferably sewn, into the bubble layer 606 along the edges, significantly improving the seam integrity by forming a composite that resists stretching, while allowing for the wearer's skin/clothing to slide easily with in the pneumatic internal cavity.

In one embodiment, the bubbles in the bubble material layer are all about 10 mm diameter, although other suitable sizes may be used. In one embodiment, we use them with a diameter of from 5 mm to 15 mm, with 10 mm preferred, more preferably uniformly sized bubbles. The bubbles are preferably filled with air at atmospheric pressure, but may be filled with other gases, e.g. nitrogen, helium, argon, Sulfur hexafluoride, $C_4F_7N$, etc. having heat transfer characteristics, or at different atmospheric pressures, provided that the resulting bubbles are at least as effective as air.

While many size bubbles may be used, the more common 10 mm bubble has shown a surprising, significant advantage over previous 'larger bubble' suits, including but not limited to increased mobility through less resistance from the suit, while at the same time allowing additional bubble layers in areas of increased heat loss. See e.g., FIG. 6B. As an example, the suit panels that comprise the back of the suit 802 (which under normal utilization would be under water when floating), may be comprised of a double bubble layer 606 (see e.g., FIG. 6C), instead of larger bubbles. Such a double panel would be stiffer, but would occur in an area of the suit where such stiffness is not a shortcoming. Again, although other suitable sizes may be used.

The CLO value reflects the degree of insulation provided by an article of clothing. A CLO value of 1 is equal to the amount of clothing required by a resting human to maintain thermal comfort at a room temperature of 21 degrees Celsius, or 71 degrees Fahrenheit (such as a business suit). A naked human has a CLO value of 0.0. Summer clothing has a CLO of 0.6. A downhill ski suit a CLO of 2.0, and a heavy polar gear suit a CLO of 4.0 (such as an Eskimo ensemble). The use of single or double (or more) bubble layers (as in a preferred embodiment example of 10 mm) creates a cold weather suit 100 with a high CLO value of 4.87. One with a triple layer of bubbles in the back (three successive layers of 10 mm bubbles) would have CLO of 6.18. A suit in accordance with an embodiment having 10 mm bubbles with a double layer in the back having a CLO of about 4.87 is still significantly higher that the regulation suit which has to be CLO 0.75.

Figure 7:
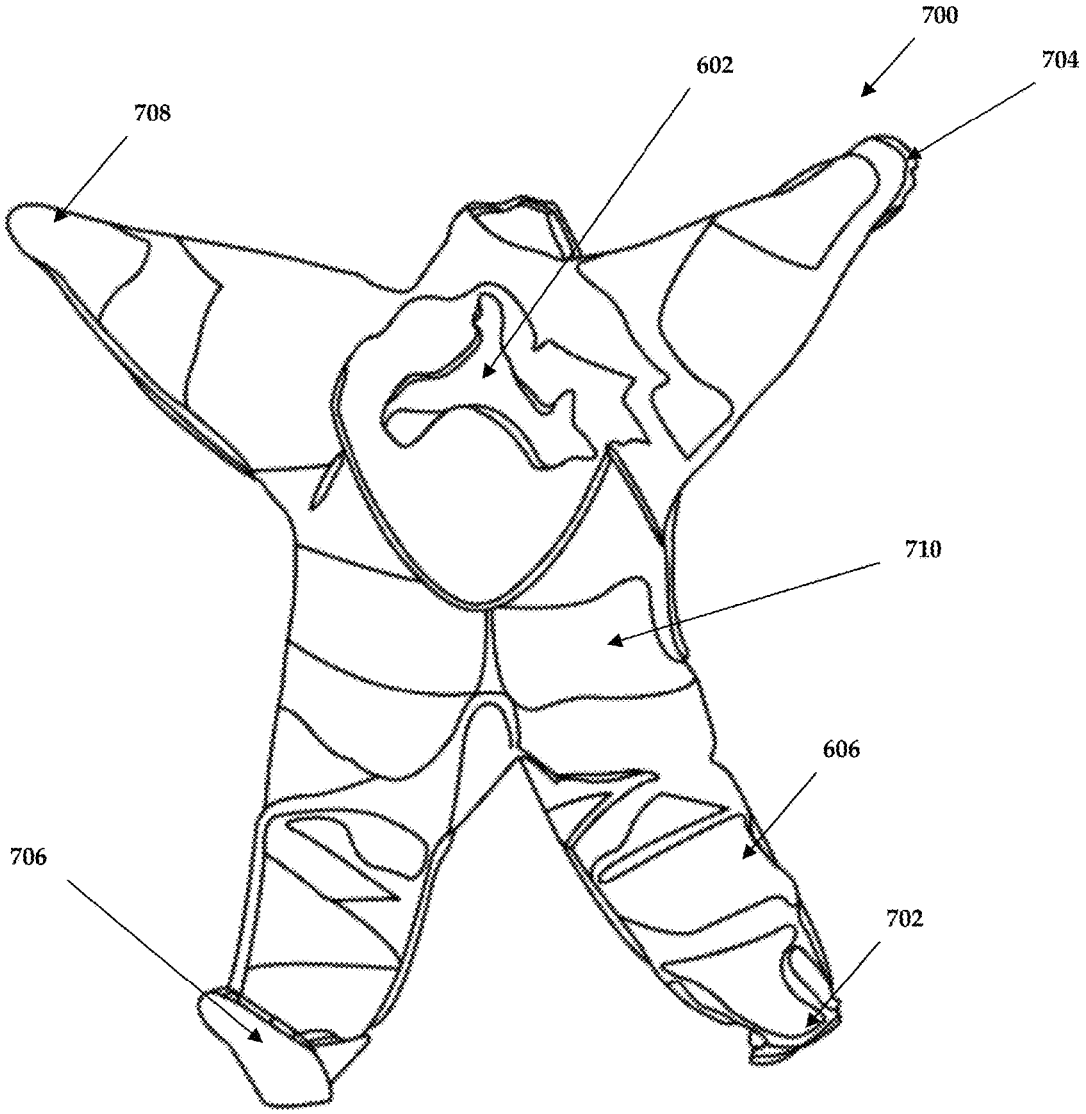
FIG. 7 shows a front view of the cold weather survival suit internal layer, according to an exemplary embodiment of the invention.
Figure 8:
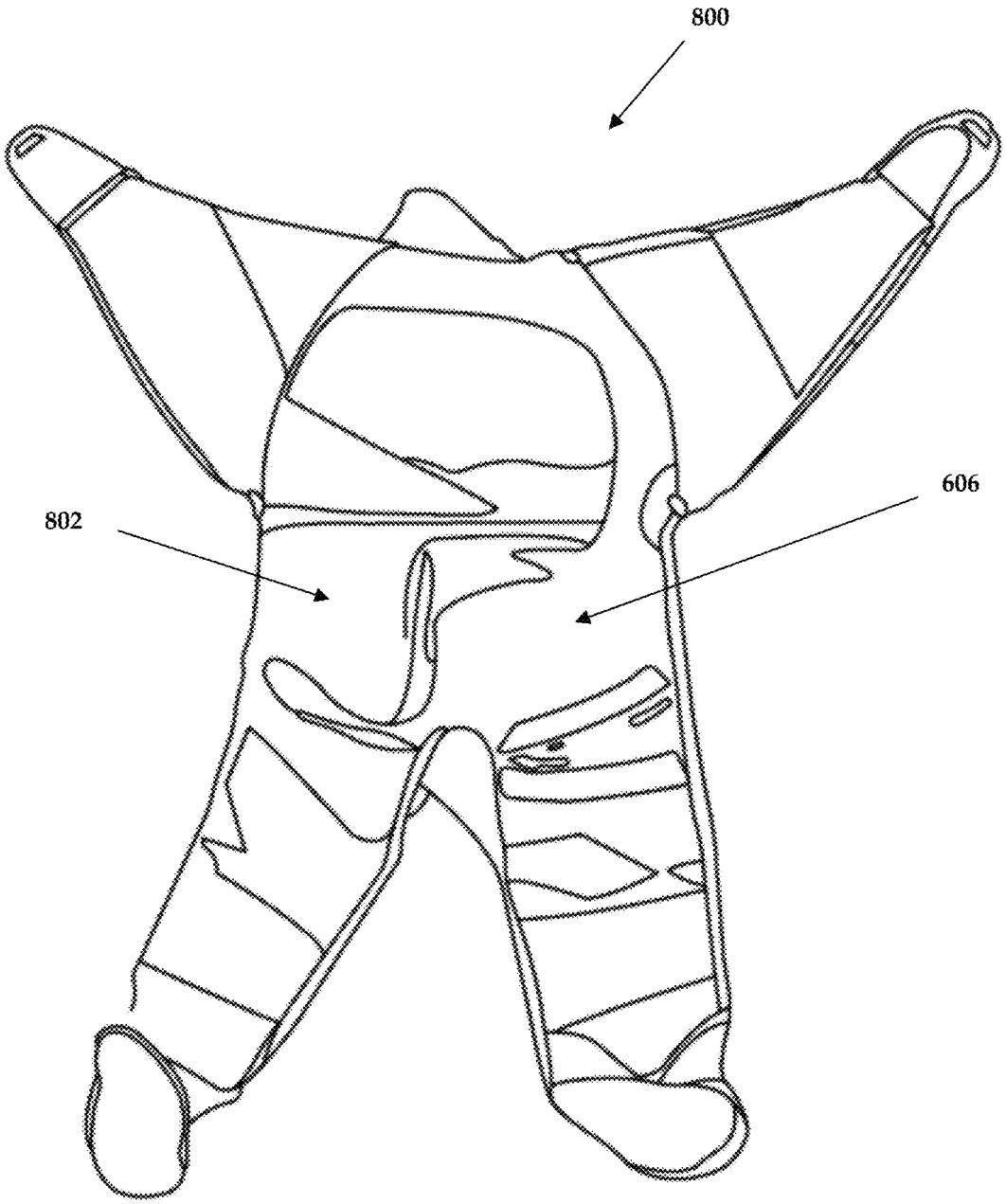
FIG. 8 shows a back view of the cold weather survival suit internal layer, according to an exemplary embodiment of the invention.

In one embodiment, the suit begins as two layers, the internal liner 604 which is sewn into the edges of the bubble layer 606 in the form of panels with a pattern, in effect the traditional way of mass suit construction. Sewing around the edges is critical, for the minimal number of perforations to the bubble layer 606 panels is desired. This results in a 'bubble' suit 700 seen in (FIGS. 7-8), which is a thermal envelope, but not waterproof. This thermal envelope is comprised of a central chamber 502 that is pneumatically connected to two leg extensions, two arm extensions and a head covering chamber.

One or more portions of said suit's 700 exterior surface is equipped with mechanical or chemical attachment components along portions of said suit. These may be components such as Velcro™ placed at locations 706/708/710 (i.e. Hooks and Loops or other similar mechanical attachment), chemical strips (glue/epoxy pads) or other similar components that will allow the inner thermal layer to be attached to the outer waterproof layer 900.

In one embodiment, an overlay for the bubble suit 700 is then created by taking similar patterns to those of the bubble envelope 700 and making a closely conforming outer suit (say 3% to 10% larger), cutting them from polyether film 608 (or other similar flexible waterproof material), and welding the ends/edges (through ultrasonic welding or needle threads that are melted), in order to create a waterproof outer shell 900, that envelopes the bubble suit 700. The bubble suit 700 has complementary attachment components to those placed on the exterior of the bubble at locations 706/708/710, but this time secured to the interior of the polyether film and placed within the interior of this impermeable shell 900. The bubble envelope, is then secured (via the complementary attachment component, e.g., Velcro™ or chemical strips or other structures) within the waterproof/impermeable shell, creating the first layer composite layer suit (Inner liner/bubble/polyether film) 900/1000. We note that the waterproof zippers/closures 904 are attached to the shell 900, in effect, this shell with the inner bubble suit 700 could be used. The main challenge, is that the film material 608 can be easily worn out, cause water to come in. However, in one embodiment, something like a light neoprene or polyurethane layer can bonded to the outside of the film 608, creating a simple suit. It should be understood that the aforementioned attachment may be permanent or not, depending on the attachment mechanism utilized, with non-permanent attachments, e.g., Velcro™ permitting replacement of a damaged component layer at needed.

In one embodiment, a more robust suit is accomplished, by creating another outer shell 1200, also 3% to 10% larger, which also closely conforms and envelopes (through similar slightly larger patterns using a material like Nylon (such as 200 Denier Oxford Nylon 610)) or other similar water-repellent, highly durable material. This layer, need not be waterproof, but simply water-repellent, so that as the suit is immersed, the weight will not increase significantly, but will have a durable, wear proof exterior 'skin' 1200 that protects against punctures/tears in the waterproof layer 900. Since some water may be trapped between the waterproof layer 900 and said outer shell 1200, one or more mesh layers 1506 are provided at portions of said outer layer 1200 to facilitate the draining of water trapped in the space between the 900 and the 1200 layers.

Attachment components, e.g., Velcro™ (i.e. hooks and loops), are attached to the outside of the impermeable shell 900 at locations such as 1002/1006/1008, and to complementary similar location within the outer shell 1200. Thus, the inner shell 900 (already containing the bubble envelope) is inserted within the outer shell and attached at similar points through complementary components located within the outer shell 1200. That is, the thermal 606, waterproof 900 and outer layer 1200 are anchored at specific points, but able to slide relative to each other slightly. The outer shell has one or more openings (either open or covered with a mesh) to allow any water caught between the waterproof 900 and outer layer 1200 to exit.

The above composite, multilayer fabric structure would be suitable for use in clothing and other shelters, such as sleeping bags, tents, rafts, etc. A similar combination (where the bottom of the raft/tent/bag) is made of double or more layers of bubbles 606, would result in a significantly insulating yet waterproof surface.

In other embodiments, the various layers, may be sewn, welded or otherwise suitably attached (including but not limited to other suitable mechanical and/or chemical means) together in various internal configurations (keeping the outer shell (made of something like Denier Oxford Nylon 610 on the outside), to create a thermal protective layer that will preserve the wearer's/occupant's heat. While in many cases when immersed in water, small amounts of liquid may seep in, the ability to contain the heat within the enclosure, would ensure that the wearer remains in conditions that would be superior to the simple immersion without the suit or enclosure.

The advantage of the insulated central cavity, inner chamber or enclosure 502 within which the human resides is critical when we envision a user residing within it as they potentially float within a body of water, on top of an ice floe, or even within a survival boat or raft. In all these situations, a modicum of water may enter the internal cavity 502, either as a result of immersion and/or through wave action or ocean spray. Such fluid however will be quickly warmed by the user's body temperature, and become an integral part of the internal cavity 502 thermal ecosystem. Since such captured water is isolated from the outside water because of the insulating layers, it will remain warm at/near body temperature.

Once the inner lining layer 604 (e.g. Ripstop nylon) is attached to the bubble material 606 (FIGS. 7-8), the shape of the suit 100 begins to take form as a thermal layer or bubble layered 700 form forming a cavity. The ripstop 604 internal layer is what comes in contact with the user's body (being inside the suit), and is attached to the outer (at this stage) bubble layer 606. We note that in one embodiment the exterior of this is shaped like a human (with options for various sizes, including an adult universal (for humans from 1.5 to 2 meters tall), Jumbo (taller humans to 2.2 m tall), Small humans, children and infants).

The suit's central cavity and head/arm/legs extensions form a single, pneumatically communicated chamber. In one embodiment, the chamber terminates into built in mittens 704 and booties 702 at the appendage extremities.

The inner layer 602 has two significant advantages. It facilitates the user sliding into the suit (something harder to do with the bubble material 606 surface against the skin), and also creates a composite that is insulating (the bubble material 606) while strong in tension (and against ripping) due to the inner layer 602. In one embodiment, an advantage of the composite, is that all the stitching is done around the edges, which are then folded inside the outermost layer, minimizing any stitching across the bubble layer 606 to areas where water won't be able to come in through the stitches into the interior.

Figure 9:
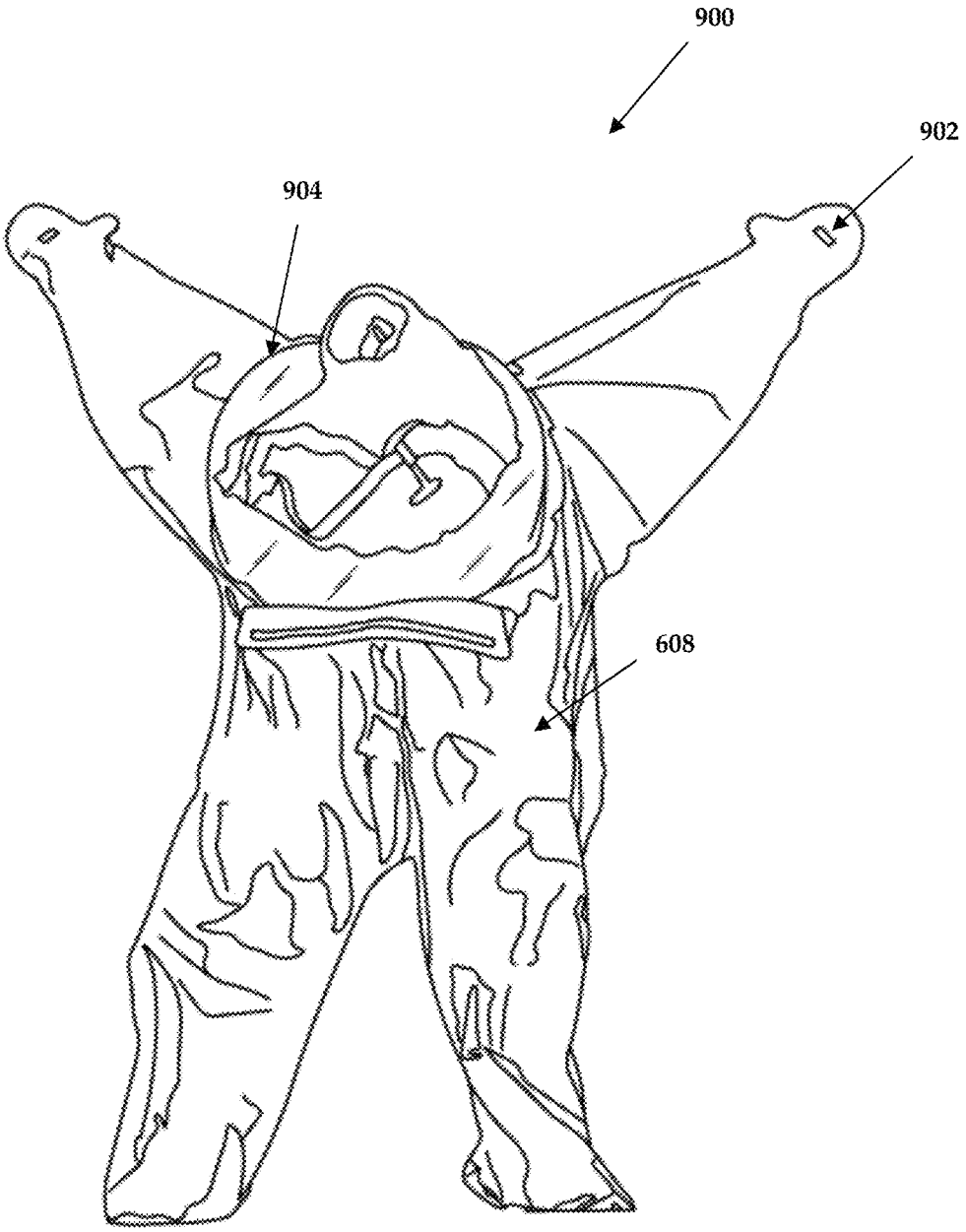
FIG. 9 shows a front view of the cold weather survival suit internal waterproof layer, according to an exemplary embodiment of the invention.
Figure 10:
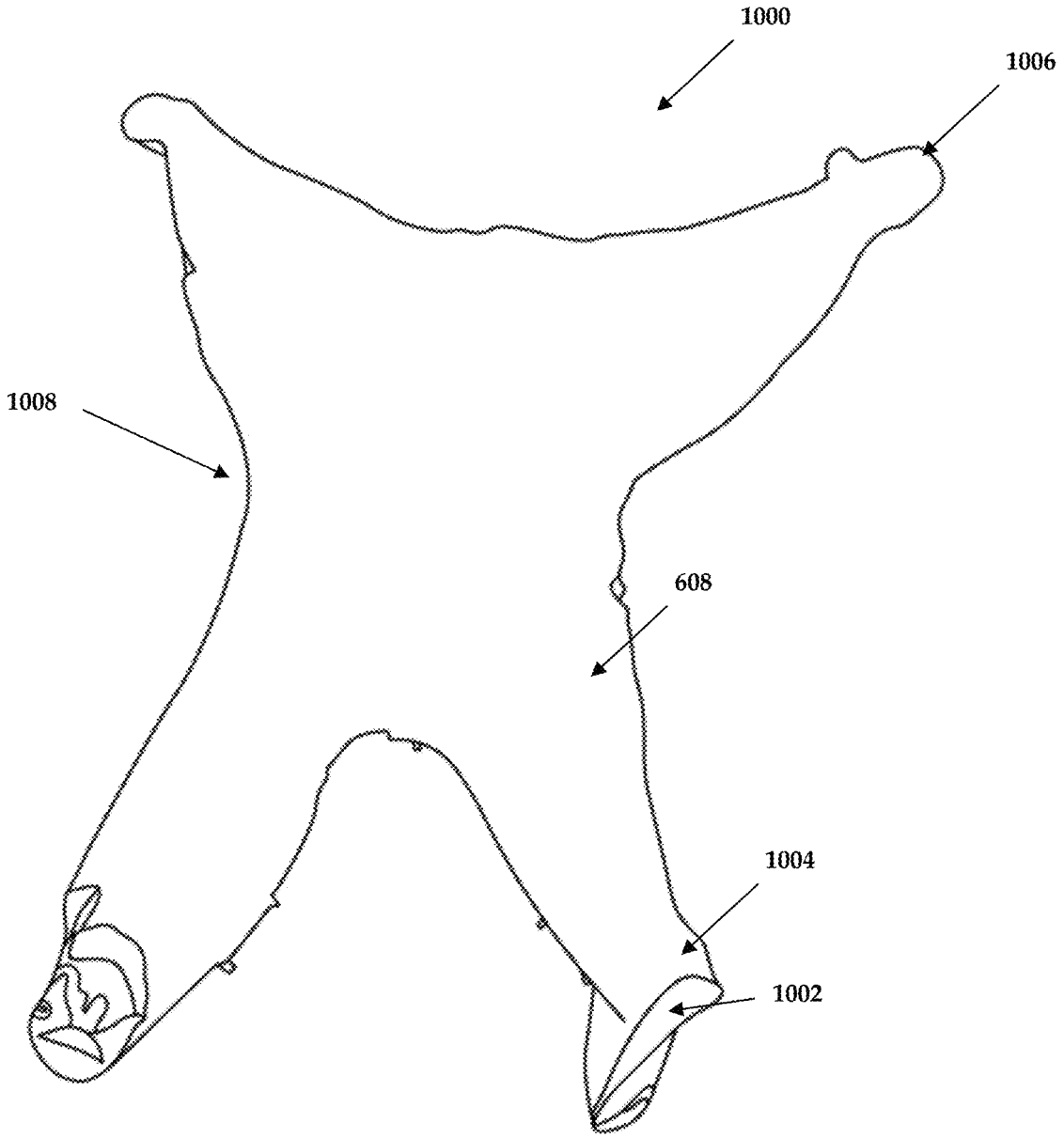
FIG. 10 shows a front view of the cold weather survival suit internal layer, according to an exemplary embodiment of the invention.

In one embodiment (FIGS. 9-10), the inner bubble shape 700 is then enclosed 900 within a polyether film 608, which provides a waterproof/water-resistant layer, as well as further structural strength. The mittens 902 at the arm extensions remain sealed. The foot area 1004 begins to be defined around the ankles as well as providing a foot support pad 1202. Such a pad may be made of plastic, rubber, metal, carbon composite or other combinations, and provides a puncture resistant material (as the user may be moving around what is a chaotic environment with debris). This area will later to be enclosed within a sandal-like structure 1700.

Figure 11:
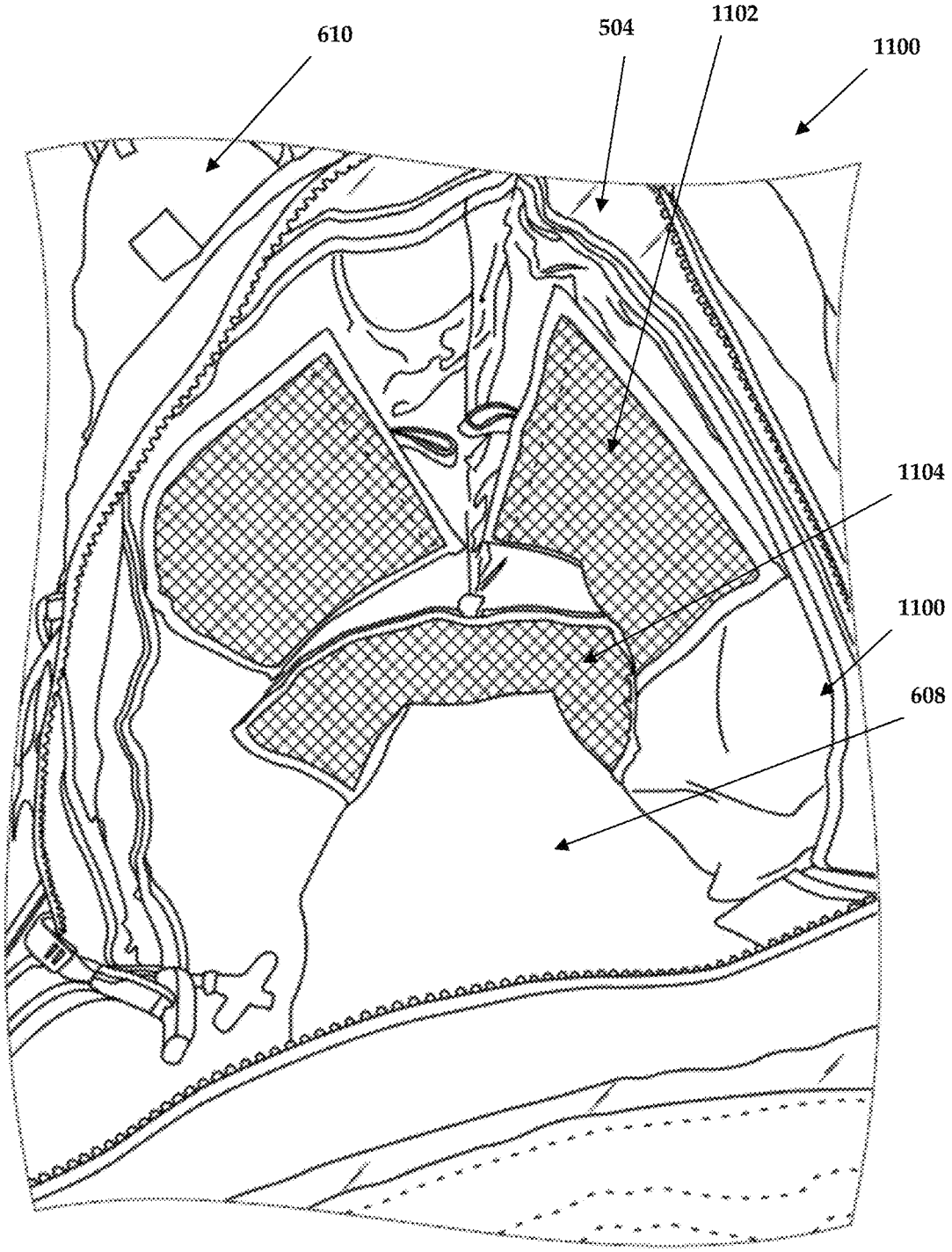
FIG. 11 shows a front perspective view of the cold weather survival suit interior storage pocket layer, according to an exemplary embodiment of the invention.

Referring to FIG. 11, we see inside details of the personal items tent or pocket 504. This is an inside facing feature that has one or more pockets 1102, 1104 within which the user may place critical items within a reasonably weather proof area that is part of the inner chamber or inner cavity 502. In this fashion, water/liquids, medications, eyewear (contacts, glasses) and rations may be kept accessible and from freezing, passports/Identifications (IDs) from being lost or damaged, and electronics (radios/phones/smartphones/satellite-phones/iPads, etc. kept similarly safe.

The location is important, for the access to these inside pockets 1102/1104 from inside the suit allows the user to have access to the items within said pockets without opening the inner cavity 502 to the outside. By placing the pockets 1102/1104 inside the thermal envelope 700, they are kept thermally warm (through the user's body). Similarly, they may be placed within the waterproof layer 900. In both cases, the content of said pocket is kept dry. You simply slide your arms off the arm extensions 108 inside the enclosure and reach for them. When the splash guard 2102 is deployed, you may then make a radio call, eat or drink, all within the splash guard volume.

Figure 12:
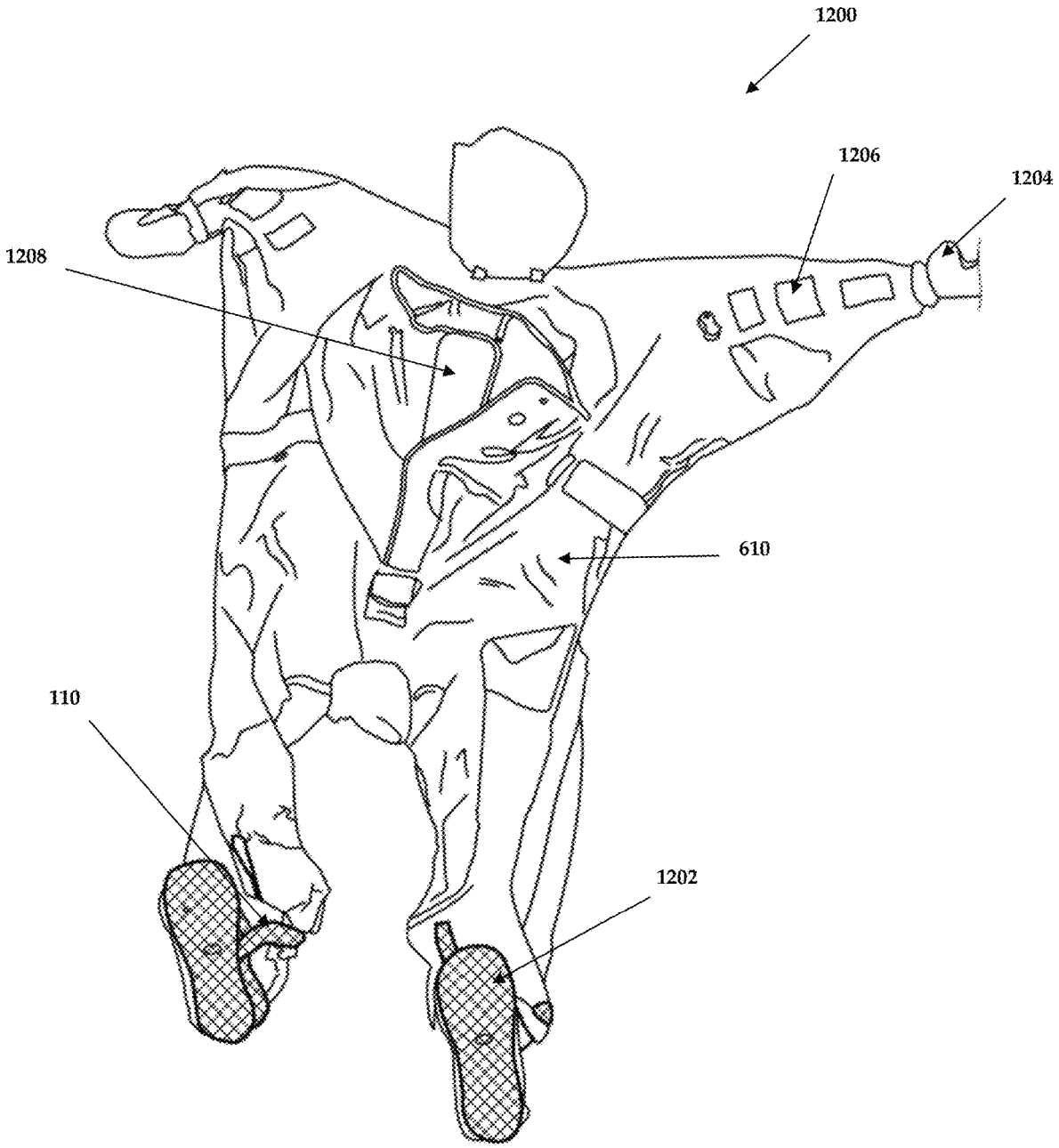
FIG. 12 shows a front view of the cold weather survival suit external layer, according to an exemplary embodiment of the invention.

The suit 100 is then (FIG. 12) attached to the outer layer 610, with the mittens 1204 receiving a final tear proof material overlay (such as neoprene or rubber), and various high visibility marks 114, 202, 204, 1206, closure components 116, 1208, and other components. Such external materials offer the advantage of additional grip force.

Figure 14:
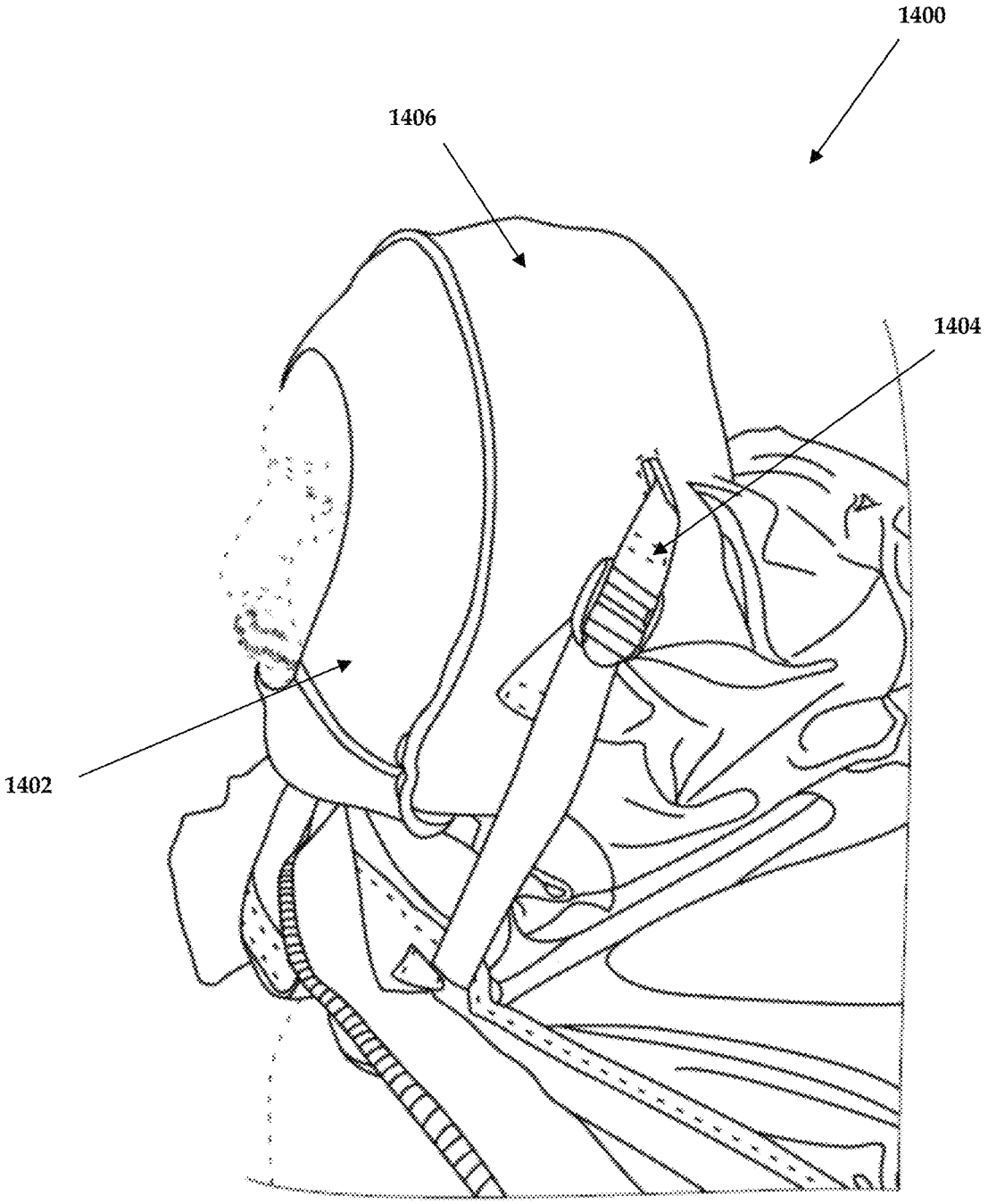
FIG. 14 shows a view of the cold weather survival suit hood worn by a user, according to an exemplary embodiment of the invention.
Figure 15:
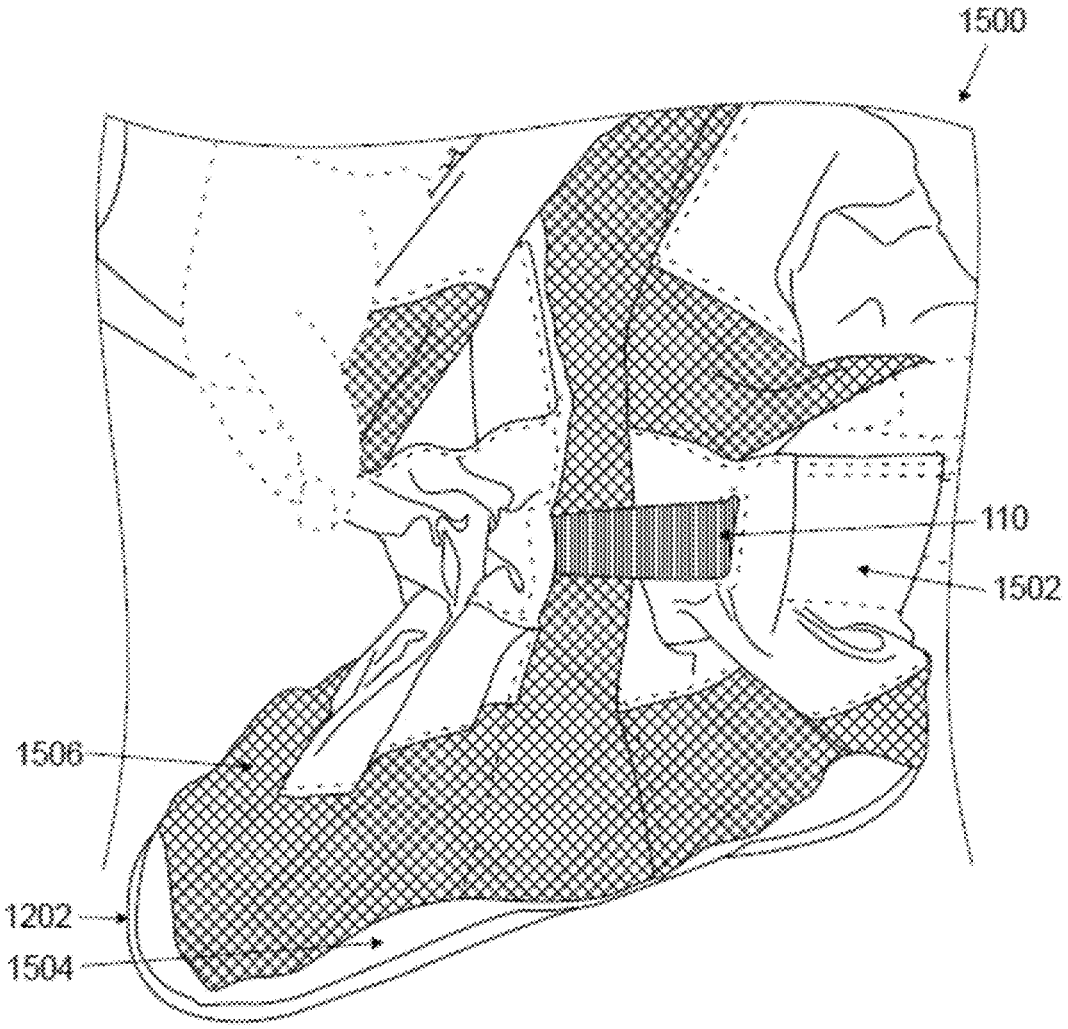
FIG. 15 shows the cold weather survival suit foot area adjustment external strap component, according to an exemplary embodiment of the invention.
Figure 16:
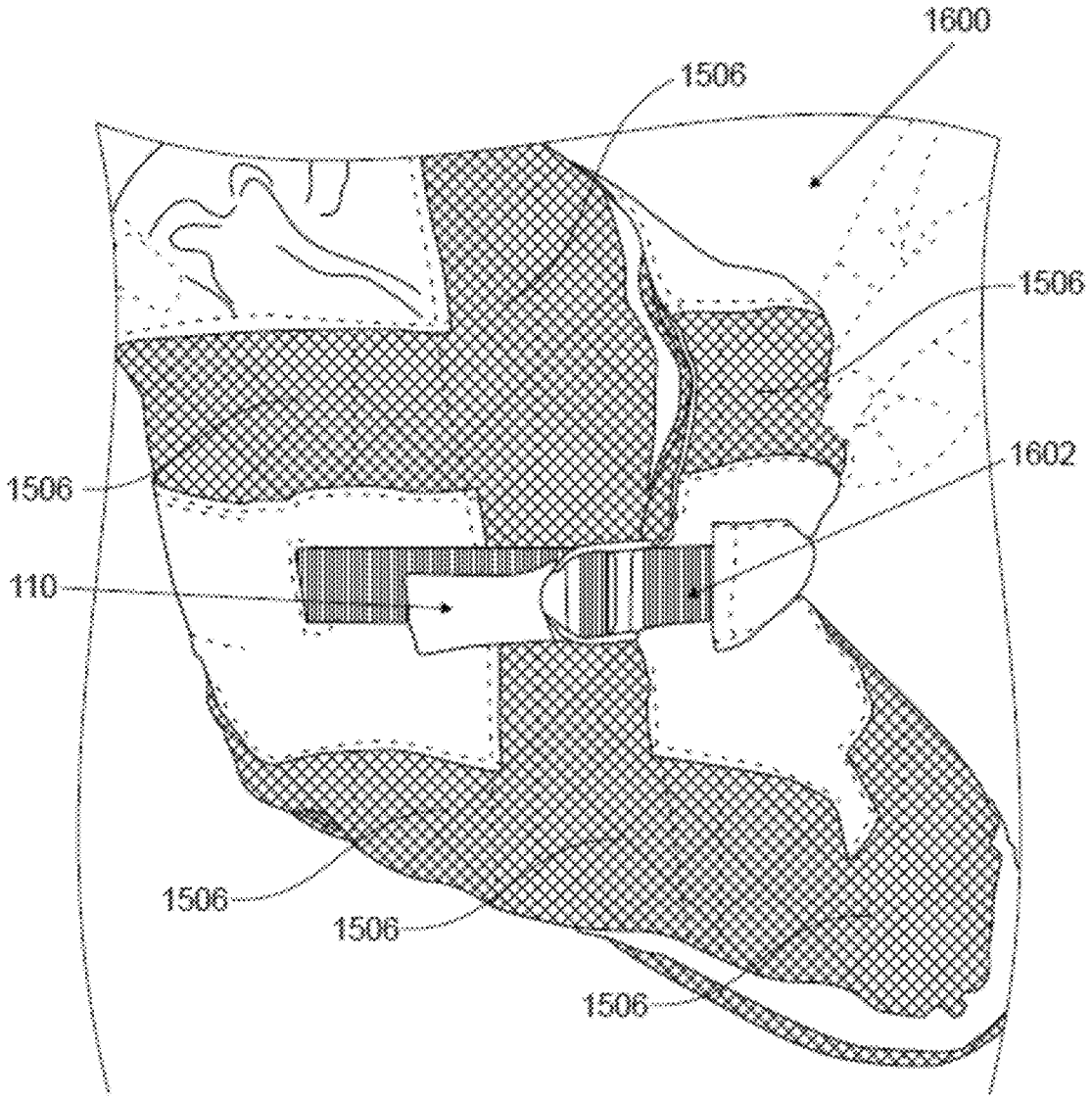
FIG. 16 shows the cold weather survival suit bootie/foot adjustment strap component, according to an exemplary embodiment of the invention.
Figure 17:
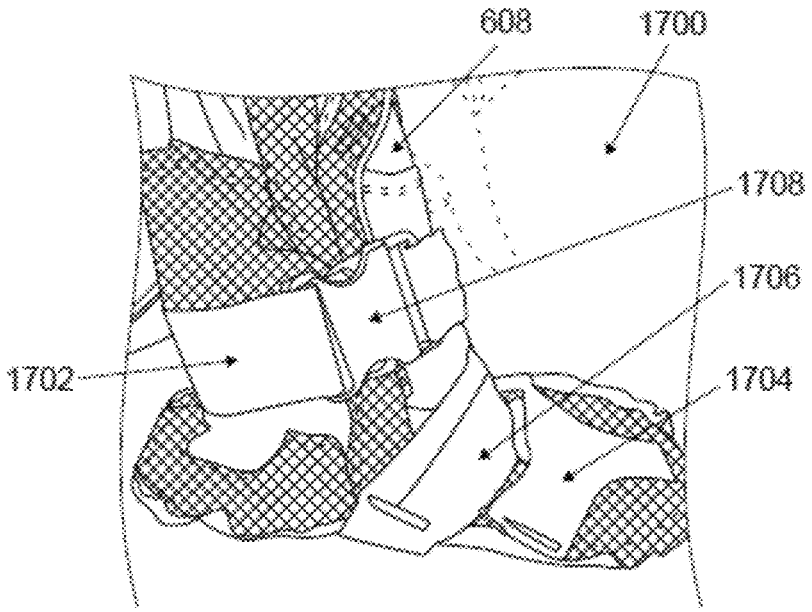
FIG. 17 shows the cold weather survival suit bootie/foot adjustment strap component around the exterior of the waterproof layer, according to an exemplary embodiment of the invention.
Figure 18:
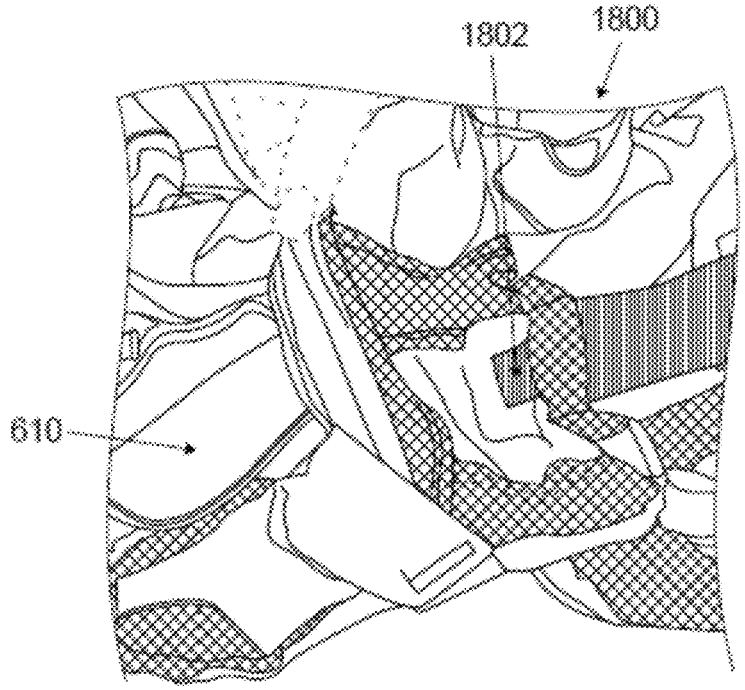
FIG. 18 shows the cold weather survival suit bootie/foot adjustment strap component around the exterior of the waterproof layer, according to an exemplary embodiment of the invention.
Figure 19:
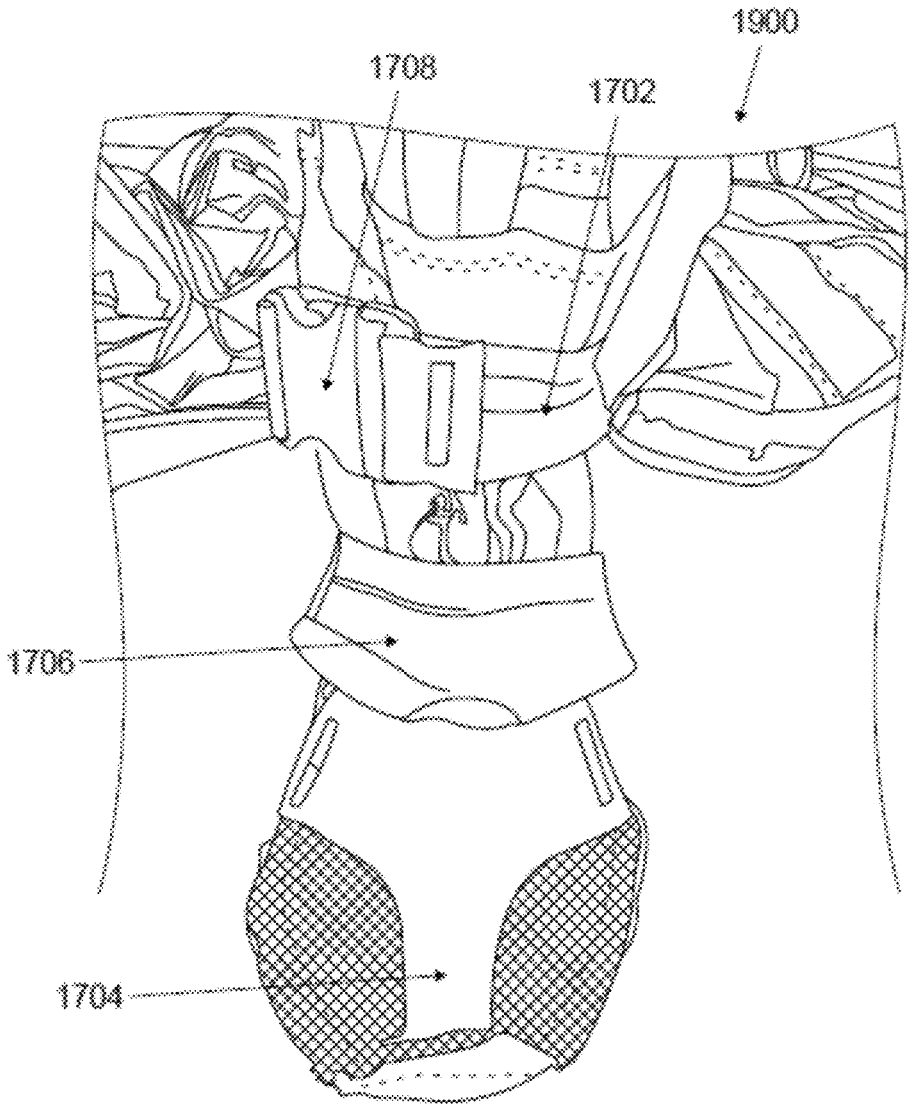
FIG. 19 shows the cold weather survival suit bootie/foot adjustment strap component around the exterior of the waterproof layer, according to an exemplary embodiment of the invention.

The head area is important for providing adequate visibility/hearing to the users. In addition, an uncovered head is an area that loses a lot of heat. For this reason, a heat-retaining impermeable hood is embodied, with a water-resistant hood (FIG. 14) is envisioned in one embodiment 1400. In one embodiment, the majority of the user's head is enclosed within a cap 1406 formed from the same composite fabric as the rest of the suit. In another embodiment, the hood or cap 1406 fabric has a double layer of bubble material 606. The frontal area (that around the face) is comprised of a flexible polychloroprene partial mask 1402 for covering most of the face as the user finds comfortable. Materials such as Neoprene or other similar scuba fabrics are suitable. The partial mask 1402 neoprene edge is attached to the hood 1406 with cement or heat seal tape, sealing the area around it. Adjustment of the cap 1406 to each user is accomplished by one or more straps 1404 that allow cinching around the head.

When a user is going to spend significant amounts of time immersed in water, the suit provides natural flotation (thanks to the inner chamber 502 natural buoyancy), but the user may not find having their face constantly splashed by water. We see in the embodiment 2100, a transparent tent or splash guard 2102 surrounds the head cover 102. As shown, the user then may close all but a small opening 2104 allowing them to see around them, and continue relaxed, without constant water immersion/splashing on their face. In one embodiment, small tubes are placed at the area around said small opening 2104, to facilitate breathing.

A final and often overlooked component of the suit 100 is found around the foot area adjustment external strap 110. This area is consequential for two reasons. The first is that most users will be moving around a chaotic scene, that may have many puncturing components around the floor/ladder areas. Since the human wearing the suit is placing (usually) most if not all their body weight on the bottom portion of the external sole 1202, this needs to be strong and preferably treaded (as the users may have to climb or board other crafts, ladders, stairs, ice flows, etc.). In one embodiment, a material such as Q.B. Soling's VIBRAM™ or similar is used, providing superior traction on snow and ice while withstanding extreme heat.

In one embodiment, a stave, shank or flat stiff member 1504 is added between the external sole 1202 and the foot bottom. This is an important surface against which the user presses their foot sole or instep as they climb a stair or ladder. This also is an important portion of the walking motion, and particularly important when wearing the suit 100. In alternate embodiments, the area around the sole 1202 has additional fire-resistant components/mixtures added to it in case the user has to step over or through, e.g. platform/shipborne portions on fire.

This action of walking, while wearing the suit, requires additional features, which in one embodiment can best be seen in FIGS. 15-19. The flexing of the ankle, as one walks, requires the affirming of the foot in a heel to ball to front of foot motion, something that can be trying, when simply having a foot within a bag. Many of us have experienced this while attempting to walk with pants that are too long, so that the foot is enclosed within the pant length. In effect, we tend to trap the front of the pant on the front of the foot.

To eliminate that effect, in accordance with a preferred embodiment we begin with a foot area adjustment external strap 110 which surrounds the user's ankle 1502 and is attached to the outer layer 610 with a position securing component 1600 (e.g. Hooks and Loops, Ladder lock 1602, or similar), which would allow the user to tighten the foot area adjustment strap 110.

The outside foot area adjustment external strap 110 is designed to work cooperatively with an interior 'sandal-like' structure 1700, preferably mounted outside the Polyether film suit layer 608 and inside the outer layer 610. In most cases, the users will remove their shoes before donning the survival suit. This provides the user with the feeling that when donning the suit, they have slipped their foot into a sandal structure. The structure is formed by an upper strap surrounding the ankle 1702, a middle portion 1706 around the foot arch, and a lower portion 1704 around the front. These straps 1702/1704/1706 are placed outside the polyether film layer 608, but inside the outer layer 610. The sandal structure 1700 thus allows the user, when the foot area adjustment external straps 110 are pulled and secured so that one or more of the inner straps 1702/1704/1707 of sandal structure 1700 are fit snugly around the foot, to walk normally (as well as to potentially swim better, as they provide a built in 'fin-like' structure), including climbing stairs/ladders while sure footed.

Another improvement 1800 over other cold weather survival suits, and one that is advantageous to the long-term wear regulatory requirements (up to 6 hours), is accomplished through the interconnection of the foot area adjustment external straps 110 and the inner straps 1702 via an interconnection band 1802. This band 1802, allows the user to release the inner strap 1702 at any time, by simply releasing the outside strap. Such a feature has proven advantageous for users that are subject to extensive water immersion, for it allows the feet to be warmed with the significantly warmer air within the central air chamber 502.

When the suit is first donned, and the inner strap is loose, the user's body is contained within a sealed inner chamber comprised of the torso, arms, legs and head. The user may, at any time, by tightening the foot area adjustment external strap 110, which proceeds to close the inner strap 1702, effectively create two isolated or semi-isolated chambers (one at each foot), preserving the heat within the upper chamber (and around the body core). Anytime the feet get too cold, the user may release the foot area adjustment external strap 110, resulting in the interconnection of the chambers at the foot to the central core, and thereby allowing for transfer of heat from the central core to the feet. In this way, the user can relatively rapidly warm the feet and the cold air formerly in the foot chambers can be intermixed with the cavity and dissipated, with the user's body temperature maintaining an acceptable temperature. Note that the above external/internal linked strap approach may be used to similarly seal the area around the hands, as well as mid-thigh, etc.

Figure 13:
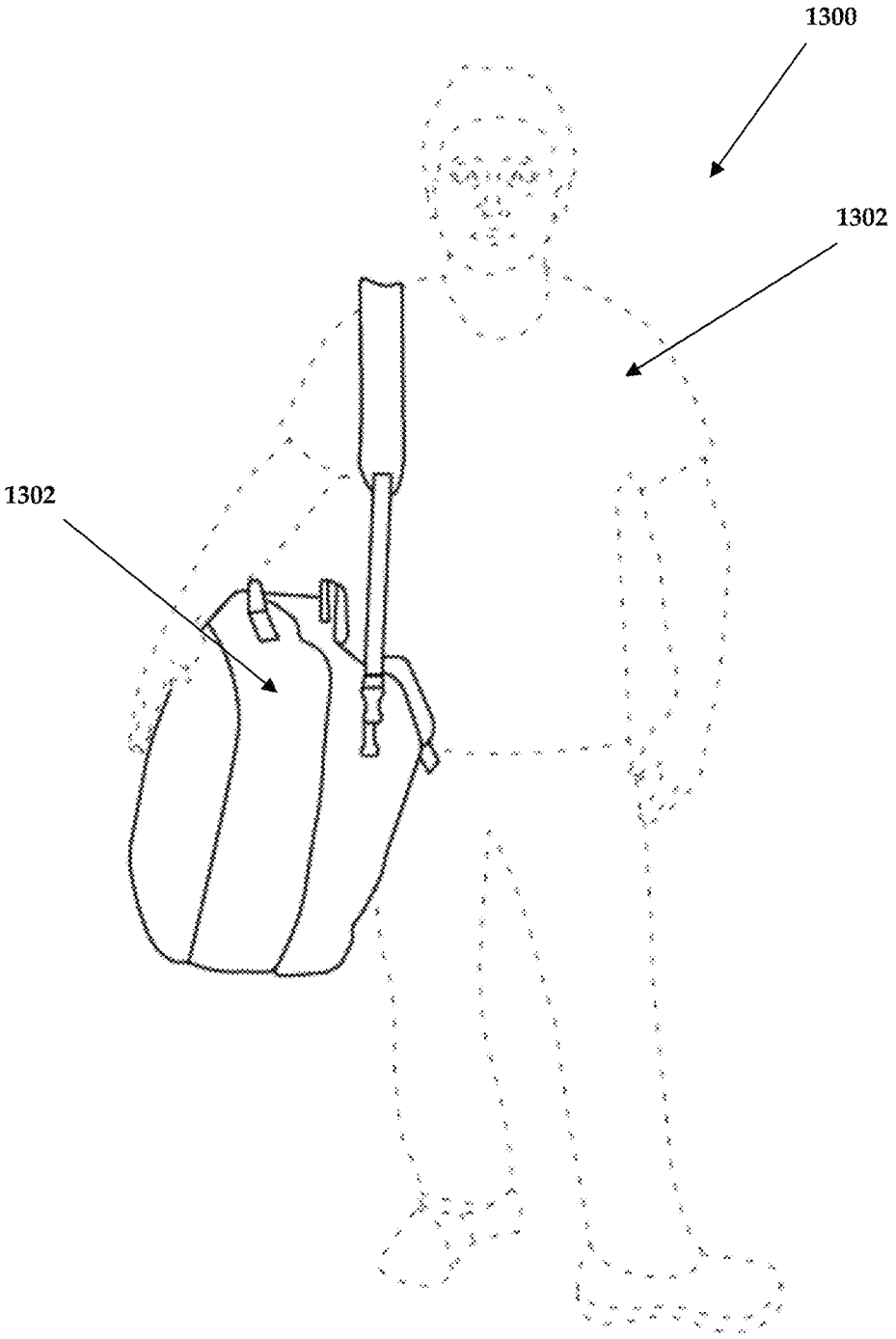
FIG. 13 shows a unit packed for use in relation to a human, according to an exemplary embodiment of the invention.

The complete unit may be then packed and kept ready for use 1300 (FIG. 13) within a compact bag 1302. In it, we can appreciate a critical advantage of using the smaller bubble material 606 in that the resulting suit can be easily carried when folded properly, has lower manufacturing costs, while remaining highly usable. We note that the smaller bubble material reduces the weight of a similar dimensioned suit having larger bubbles of up to about 30 mm by up to 20%.

Figure 20:
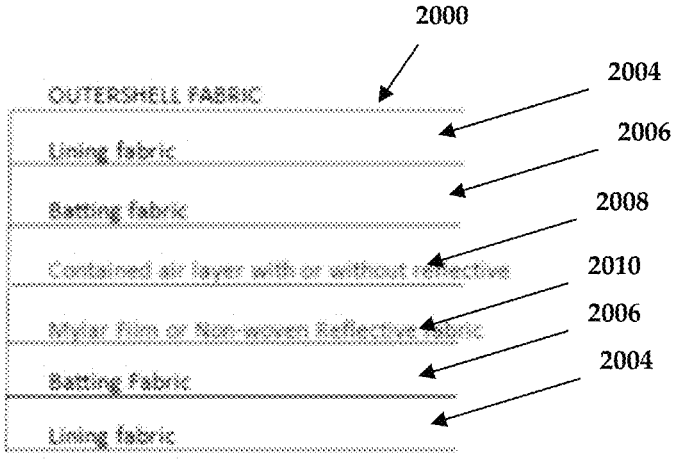
FIG. 20 shows the material layers that comprise a possible embodiment of the composite fabric of the cold weather survival suit for sleeping bags or coats, according to an exemplary embodiment of the invention.
Figure 21:
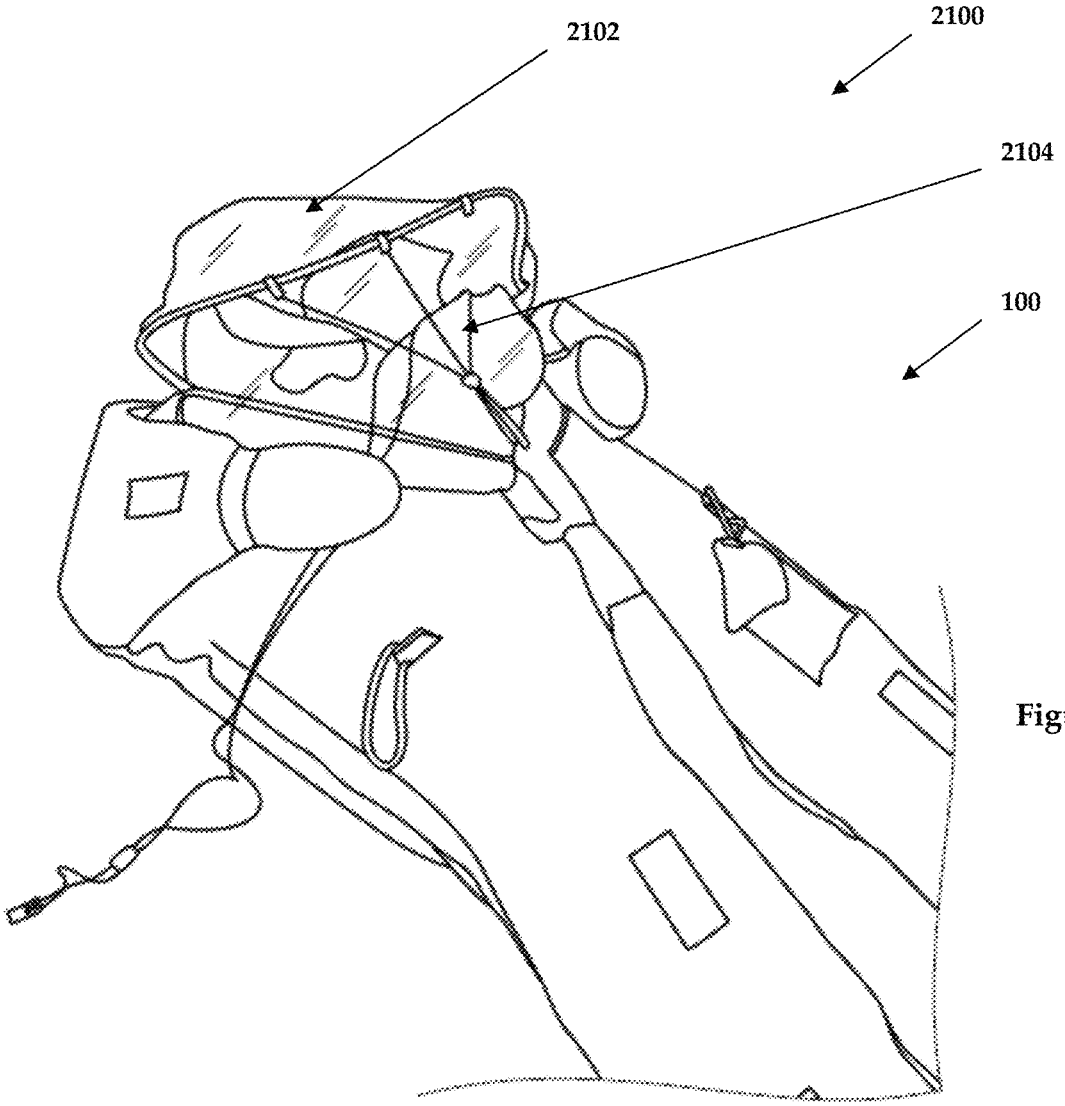
FIG. 21 shows the suit with a deployed splash guard, according to an exemplary embodiment of the invention.

In another embodiment (FIG. 20), the primary outer layer 2002 is comprised of an outer shell fabric that is optionally waterproof, water-resistant or water-repellent layer. A material such as Balloon Wide HST (Heal Seal Technology), 70D Nylon Ripstop with TPU (Polyurethane Coating) Backing may be used. This material can be obtained from suppliers such as the Brookwood Company. Such a material may be obtained in high-visibility colors or any other suitable color. In such an embodiment, one or more batting fabric layers 2006 (comprised of a suitable batting material such as the Polartec™ Power Fill 135, Style 8864, which may be obtained from a supplier like Polartec™), are sandwiched within the inner layer 2004 comprised of a material such as a lightweight and soft fabric such as Oxford or Ripstop. An optional mylar or other suitable reflective material, such as VIVOSUN Horticulture Highly Reflective Mylar Film R may be included between the inner layer and batting layer.

In such an embodiment, a batting layer 2006 may be comprised of a suitable batting material. A material such as the Polartec™ Power Fill 135, Style 8864, which may be obtained from a supplier like Polartec™. A lining fabric layer 2004 may be comprised of a material such as a lightweight, soft fabric such as Oxford or Ripstop. It may be used to sew the layers together, giving the seam more strength, to slide into the garment easier, and to have a better finish. An optional mylar or other suitable reflective material, such as VIVOSUN Horticulture Highly Reflective Mylar Film R may be included. Another optional material 2008 may be comprised of a suitable contained-air (sometimes called bubble wrap) material, such as TempShield™ Bubbles Foil/White, Radiant Foil, Style TS-SBFW-48, obtainable from a supplier such as Radiant Foil.

In another embodiment, an alternative to be used in conjunction with SHELL, LINING layers is Aerogel, either alone or with contained-air layer and or Mylar. This Aerogel layer can be any thickness and as an example can be supplied by Cabot. Thermal Wrap™ aerogel blankets from Cabot provide the insulating properties of silica aerogel in a flexible form that is virtually dust-free. It is known for use in engineering projects involving ambient and sub-ambient insulating applications, and more. It is easy to cut and handle, and is useful as a translucent fabric for daylighting and acoustic damping in buildings. Thermal conductivity is ~23 mW m−1 K−1 at room temperature. It is an alternative to Spaceloft® or Cryogel® for dust-sensitive applications. Operating temperature of −200° C. to 125° C. with 160° C. peaks.

In one embodiment, the proposed suit has the advantages that it would protect against hypothermia for 25 hours, resists direct contact with flames for 4 seconds, withstands impact from jumps of up to 10 meters, partially don in 15 seconds or fully don in 60 seconds, if donned wet will restore core body temperature within 10 minutes, retractable protective cabin (i.e., the splash guard) for added protection, vertical and horizontal floating capabilities, pre-lubricated zippers that are waterproof and require no maintenance, built-in harness for user comfort and faster extraction, optionally an extra flotation device (not required) and a SOLAS approved buddy line, whistle, and light.

The advantages and improvements in the above can be clearly seen when compared to previous suits like US Pat. Pub. No. 2019/0308700, which attempts a multi-bubble size approach. Such an approach results in a stiffer, harder to wear and move around while wearing suit, which we have eliminated by using bubbles of a preferred size around 10 mm or smaller.

In one embodiment, another important addition to the above suit, is the integration of an Emergency Position Indicating Radio Beacon (EPIRB) attached to the suit (either internally or externally). The EPIRB may be activated through deployment, extraction of the suit from the storage container/bag 1302, manual activation (stored in the pouch 1102), or wetness (attached to the outside of the suit). Similarly, a light may be similarly placed and activated. In another embodiment, the suit 100 may have a communication system built in, with either a microphone, headset, earpiece, or molar communicator (similar to the SONITUS™ Molar microphone.

CONCLUSION

In concluding the detailed description, it should be noted that it would be obvious to those skilled in the art that many variations and modifications can be made to the shown embodiments without substantially departing from the principles of the present invention. Also, such variations and modifications are intended to be included herein within the scope of the present invention as set forth in the disclosure.

It should be emphasized that the above-described embodiments of the present invention, particularly any "exemplary embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention.

The invention claimed is:

1. A flexible cold weather survival suit for a user comprising:

a first inner thermal layer forming a central cavity pneumatically connected to two leg extensions, two arm extensions and a head covering having a face opening, wherein said thermal layer cavity includes one or more attachment components at various locations of said thermal layer's exterior;

wherein said thermal layer comprises an internal lining layer and a thermally insulating bubble layer attached together, wherein said thermal layer bubbles are comprised of similar sized bubbles that have a diameter of between 5 mm and 15 mm and a height of 3 mm to 6 mm;

a second waterproof layer dimensioned to envelop said inner thermal layer , said waterproof layer including one or more internal attachment components complementary to said thermal layer's attachment components, so as to couple said waterproof layer together to said inner thermal layer;

wherein said waterproof layer is formed from a waterproof material, including a flexible hood having a seal around the user's face area of said thermal layer's head covering;

said second layer has one or more front opening/closing mechanical components for sealing the interior of said second layer, including said thermal cavity;

said internal lining materials are comprised of one or more of:

ripstop fabric, ripstop nylon, high modulus polyethylene (HMPE), or nylon;

said thermally insulating bubble layer materials are comprised of one or more of:

bubble layer, bubble layer with foil, radiant foil or aerogel; and said waterproof layer materials are comprised of one or more of:

plastic film, polyether film or polyurethane .

2. the survival suit of claim 1 wherein:

an internal suit storage pocket is affixed to one of said waterproof layer interior and said inner thermal layer.

3. the survival suit of claim 2 wherein:

each said leg extension includes a sandal-like foot support structure outside said waterproof layer in addition to a strap completely surrounding said waterproof layer, so that cinching said strap pneumatically separates the distal foot area from said central cavity leg extension; and each said leg extension include an external foot sole.

4. the survival suit of claim 3 wherein:

said external foot sole includes a stave.

5. the survival suit of claim 4 wherein:

said bubble layers include aluminized layers on their exteriors.

6. A flexible cold weather survival suit for a user comprising:

a first inner thermal layer forming a central cavity pneumatically connected to two leg extensions, two arm extensions and a head covering having a face opening, wherein said thermal layer cavity includes one or more attachment components at various locations of said thermal layer's exterior;

wherein said thermal layer comprises an internal lining layer and a thermally insulating bubble layer attached together, wherein said thermal layer bubbles are comprised of similar sized bubbles that have a diameter of between 5 mm and 15 mm and a height of 3 mm to 6 mm;

a second waterproof layer dimensioned to envelop said inner thermal layer, said waterproof layer including one or more internal attachment components complementary to said thermal layer's attachment components, so as to couple said waterproof layer together to said inner thermal layer;

wherein said waterproof layer is formed from a waterproof material, including a flexible hood having a seal around the user's face area of said thermal layer's head covering;

said second layer has one or more front opening/closing mechanical components for sealing the interior of said second layer, including said thermal cavity;

one or more attachment components added to the exterior of said waterproof layer;

a third protective outer layer enveloping said waterproof layer, said outer layer including internal attachment components complementary to said waterproof's layer external attachment components, so as to couple said outer layer to said waterproof layer; and wherein said outer layer is formed from one or more materials, including wear resistant fibers, mechanical closure components, and slip resistant soles.

7. the survival suit of claim 6 wherein:

said internal lining materials are comprised of one or more of:

ripstop fabric, ripstop nylon, high modulus polyethylene (HMPE), or nylon;

said thermally insulating bubble layer materials are comprised of one or more of:

bubble layer, bubble layer with foil, radiant foil or aerogel;

said waterproof layer materials are comprised of one or more of:

plastic film, polyether film, neoprene or polyurethane; and said outer layer materials are comprised of one or more of:

Nylon, Denier Oxford Nylon, plastic or water-repellent fibers.

8. the survival suit of claim 7 wherein:

each said leg extension includes a sandal-like foot support structure outside said waterproof layer;

each said leg extension includes an external strap linked to an internal strap surrounding said waterproof film layer, so that cinching of said external strap pneumatically separates the foot area from said central cavity leg extension; and each said leg extension includes an external foot sole.

9. the survival suit of claim 8 wherein:

said waterproof layer includes an internal suit storage pocket is affixed to one of said waterproof layer interior and said inner thermal layer.

10. A flexible cold weather survival suit for a user comprising:

a first inner thermal layer forming a central cavity pneumatically connected to two leg extensions, two arm extensions and a head covering having a face opening, wherein said thermal layer cavity includes one or more attachment components at various locations of said thermal layer's exterior;

wherein said thermal layer comprises an internal lining layer and a thermally insulating bubble layer attached together;

a second waterproof layer dimensioned to envelop said inner thermal layer, said waterproof layer including one or more internal attachment components complementary to said thermal layer's attachment components, so as to couple said waterproof layer together to said inner thermal layer;

wherein said waterproof layer is formed from a waterproof material, including a flexible hood having a seal around the user's face area of said thermal layer's head covering;

said second layer has one or more front opening/closing mechanical components for sealing the interior of said second layer, including said thermal cavity;

each said leg extension includes a sandal-like foot support structure outside said waterproof layer in addition to a strap completely surrounding said waterproof layer, so that cinching said strap pneumatically separates the distal foot area from said central cavity leg extension;

said internal lining materials are comprised of one or more of:

ripstop fabric, ripstop nylon, high modulus polyethylene (HMPE), or nylon;

said thermally insulating bubble layer materials are comprised of one or more of:

bubble layer, bubble layer with foil, radiant foil or aerogel; and said waterproof layer materials are comprised of one or more of:

plastic film, polyether film or polyurethane; and each said leg extension include an external foot sole.

11. the survival suit of claim 10 wherein:

an internal suit storage pocket is affixed to one of said waterproof layer interior and said inner thermal layer.

12. the survival suit of claim 11 wherein:

said external foot sole includes a stave.

13. the survival suit of claim 12 wherein:

wherein said thermal layer bubbles are comprised of similar sized bubbles that have a diameter of between 5 mm and 15 mm and a height of 3 mm to 6 mm; and said bubble layers include aluminized layers on their exteriors.

14. A flexible cold weather survival suit for a user comprising:

a first inner thermal layer forming a central cavity pneumatically connected to two leg extensions, two arm extensions and a head covering having a face opening, wherein said thermal layer cavity includes one or more attachment components at various locations of said thermal layer's exterior;

wherein said thermal layer comprises an internal lining layer and a thermally insulating bubble layer attached together, wherein said thermal layer bubbles are comprised of similar sized bubbles that have a diameter of between 5 mm and 15 mm and a height of 3 mm to 6 mm;

a second waterproof layer dimensioned to envelop said inner thermal layer, said waterproof layer including one or more internal attachment components complementary to said thermal layer's attachment components, so as to couple said waterproof layer together to said inner thermal layer;

wherein said waterproof layer is formed from a waterproof material, including a flexible hood having a seal around the user's face area of said thermal layer's head covering;

said second layer has one or more front opening/closing mechanical components for sealing the interior of said second layer, including said thermal cavity;

one or more attachment components added to the exterior of said waterproof layer;

a third protective outer layer enveloping said waterproof layer, said outer layer including internal attachment components complementary to said waterproof's layer external attachment components, so as to couple said outer layer to said waterproof layer;

each said leg extension include an external foot sole; and wherein said outer layer is formed from one or more materials, including wear resistant fibers, mechanical closure components, and slip resistant soles.

15. the survival suit of claim 14 wherein:

said internal lining materials are comprised of one or more of:

ripstop fabric, ripstop nylon, high modulus polyethylene (HMPE), or nylon;

said thermally insulating bubble layer materials are comprised of one or more of:

bubble layer, bubble layer with foil, radiant foil or aerogel;

said waterproof layer materials are comprised of one or more of:

plastic film, polyether film, neoprene or polyurethane; and said outer layer materials are comprised of one or more of:

Nylon, Denier Oxford Nylon, plastic or water-repellent fibers.

16. the survival suit of claim 15 wherein:

each said leg extension includes a sandal-like foot support structure outside said waterproof layer;

each said leg extension includes an external strap linked to an internal strap surrounding said waterproof film layer, so that cinching of said external strap pneumatically separates the foot area from said central cavity leg extension; and each said leg extension includes an external foot sole.

17. the survival suit of claim 16 wherein:

said waterproof layer includes an internal suit storage pocket is affixed to one of said waterproof layer interior and said inner thermal layer.

* * * * *